US011337021B2

(12) United States Patent
Ilda

(10) Patent No.: US 11,337,021 B2
(45) Date of Patent: May 17, 2022

(54) HEAD-RELATED TRANSFER FUNCTION GENERATOR, HEAD-RELATED TRANSFER FUNCTION GENERATION PROGRAM, AND HEAD-RELATED TRANSFER FUNCTION GENERATION METHOD

(71) Applicant: Chiba Institute of Technology, Chiba (JP)

(72) Inventor: Kazuhiro Ilda, Yokohama (JP)

(73) Assignee: Chiba Institute of Technology, Chiba (JP)

( * ) Notice: Subject to any disclaimer, the term of this patent is extended or adjusted under 35 U.S.C. 154(b) by 0 days.

(21) Appl. No.: 17/114,678

(22) Filed: Dec. 8, 2020

(65) Prior Publication Data

US 2021/0368285 A1 Nov. 25, 2021

(30) Foreign Application Priority Data

May 22, 2020 (JP) ..... JP2020-090035
Dec. 2, 2020 (JP) ..... JP2020-200590

(51) Int. Cl.
*H04S 7/00* (2006.01)
*H04R 1/22* (2006.01)

(52) U.S. Cl.
CPC ..... *H04S 7/302* (2013.01); *H04R 1/22* (2013.01); *H04S 2420/01* (2013.01)

(58) Field of Classification Search
CPC ..... H04S 7/302; H04S 2420/01; H04R 1/22
See application file for complete search history.

(56) References Cited

U.S. PATENT DOCUMENTS 6,795,556 B1 * 9/2004 Sibbald ..... H04S 1/002 381/17
9,681,250 B2 * 6/2017 Luo ..... H04S 7/303
(Continued)

FOREIGN PATENT DOCUMENTS

JP 2008-211834 9/2008
JP A-2016-201723 12/2016
(Continued)

OTHER PUBLICATIONS

Aizaki et al., "Band-divided notch-peak model for head-related transfer function—Relation between divided bandwidth and accuracy of sound image localization," (w/ Partial English Translation) 2019 Graduation Research Summary, Jan. 29, 2020, 12 pages.
(Continued)

*Primary Examiner* — Jason R Kurr
(74) *Attorney, Agent, or Firm* — Dority & Manning, P.A.

(57) ABSTRACT

An object is to acquire a head-related transfer function reproducing features of a head-related transfer function of a listener without actually measuring the head-related transfer function of the listener. A head-related transfer function generator includes: acquiring data that represents an actually measured head-related impulse response of sound waves arriving at external auditory meatus entrances of a listener for training; calculating an initial head-related impulse response by applying a window function to the actually measured head-related impulse response and generating data representing an early head-related transfer function by performing a Fourier transform on the initial head-related impulse response; dividing the early head-related transfer function into a plurality of frequency bands; and executing a process of extracting a peak or a notch on the basis of curvature of the early head-related transfer function and a process of determining a relative amplitude for each of the plurality of frequency bands and generating data represent-
(Continued)

ing a modeled head-related transfer function of the listener for training by interpolating points representing the relative amplitudes.

24 Claims, 22 Drawing Sheets

(56) References Cited

U.S. PATENT DOCUMENTS

| | | | | |
|---|---|---|---|---|
| 9,961,466 | B2 * | 5/2018 | Oh | H04S 7/303 |
| 2015/0156599 | A1 * | 6/2015 | Romigh | H04S 5/005 381/17 |
| 2019/0014431 | A1 * | 1/2019 | Lee | H04S 7/301 |
| 2020/0374647 | A1 | 11/2020 | Cappello et al. | |

FOREIGN PATENT DOCUMENTS

| | | |
|---|---|---|
| JP | 2017-085362 | 5/2017 |
| JP | 2019-169835 | 10/2019 |
| JP | 2020-170938 | 10/2020 |

OTHER PUBLICATIONS

Aizaki et al., "Band-divided notch-peak model for head-related transfer function—Relation between divided bandwith and accuracy of sound image localization," (w/ Partial English Translation) Proceedings of the Acoustical Society of Japan, Japanese Acoustical Society 2020 Spring Research Conference Mar. 2, 2020, 28 pages.

Nishiyama et al., "Category estimation of notch frequency of individual head-related transfer function based on auricle shape," (w/ English Translation) 3-4-4, Reports of the meeting of the Acoustical Society of Japan, Sep. 2020, 11 pages.

Japanese Notice of Allowance (w/ English translation) for corresponding JP Application No. 2020-200590, dated Oct. 26, 2021, 5 pages.

* cited by examiner

FIG. 23

| INTEGRATED FREQUENCY BAND | 1 | | | 2 | | | | | |
|---|---|---|---|---|---|---|---|---|---|
| FREQUENCY BAND | 41 | 42 | 43 | 44 | 45 | 46 | 47 | 48 | 49 |
| CENTER FREQUENCY [kHz] | 6.3 | 6.7 | 7 | 7.5 | 8 | 8.4 | 9 | 9.5 | 10 |
| NUMBER OF PINNA | 8 | 8 | 10 | 23 | 12 | 10 | 2 | 3 | 0 |

FIG. 24

| INTEGRATED FREQUENCY BAND | | 1 | | | 2 | | | | |
|---|---|---|---|---|---|---|---|---|---|
| FREQUENCY BAND | 46 | 47 | 48 | 49 | 50 | 51 | 52 | 53 | 54 |
| CENTER FREQUENCY [kHz] | 8.4 | 9 | 9.5 | 10 | 10.6 | 11.2 | 11.9 | 12.5 | 13.2 |
| NUMBER OF PINNA | 1 | 8 | 10 | 14 | 13 | 21 | 6 | 1 | 2 |

HEAD-RELATED TRANSFER FUNCTION GENERATOR, HEAD-RELATED TRANSFER FUNCTION GENERATION PROGRAM, AND HEAD-RELATED TRANSFER FUNCTION GENERATION METHOD

BACKGROUND OF THE INVENTION

Field of the Invention

The present invention relates to a head-related transfer function generator, a head-related transfer function generation program, and a head-related transfer function generation method.

Priority is claimed on Japanese Patent Application No. 2020-090035, filed May 22, 2020 and Japanese Patent Application No. 2020-200590, filed Dec. 2, 2020, the content of which is incorporated herein by reference.

Description of Related Art

Conventionally, research and development have progressed for the purpose of practical implementation of a three-dimensional acoustic system, virtual reality (VR) of sounds, and the like. For realizing practical implementation of such technologies, it is necessary to reproduce a head-related transfer function for each listener. As an example of a technology for reproducing a head-related transfer function for each listener, there is a head-related transfer function selecting device disclosed in Patent Document 1.

This head-related transfer function selecting device includes a measurement unit, a feature quantity extracting unit and a characteristic selecting unit. The measurement unit acquires a head-related impulse response of a user on the basis of a speech signal received by a microphone worn on the ears of the user in a state in which predetermined speech is generated as a measurement signal from a speaker. The feature quantity extracting unit extracts a feature quantity of frequency characteristics corresponding to the head-related impulse response. The characteristic selecting unit selects one head-related transfer function from a database in which a head-related transfer function of each of a plurality of persons and a feature quantity of the head-related transfer function are associated with each other on the basis of the extracted feature quantity.

PATENT DOCUMENTS

[Patent Document 1] Japanese Unexamined Patent Application, First Publication No. 2016-201723

SUMMARY OF THE INVENTION

However, the head-related transfer function selecting device described above only selects one of a plurality of head-related transfer functions stored in the database. For this reason, in a case in which a head-related transfer function that is appropriate for a listener is not stored in the database, naturally, the head-related transfer function selecting device cannot select a head-related transfer function that is appropriate for the listener.

In addition, in a case in which the head-related transfer function of a listener is to be actually measured, since it is necessary to exclude effects of unnecessary reflective sounds, surrounding noises, and the like, it is necessary to perform measurement not in a house, an office, and the like but in an anechoic chamber. However, anechoic chambers are present only in limited research organizations. In addition, a general user not having sufficient specialized knowledge of acoustics cannot measure a head-related transfer function of the user who is a listener with sufficient accuracy.

The present invention is in view of the problems described above, and an object thereof is to provide a head-related transfer function generator, a head-related transfer function generation program, and a head-related transfer function generation method capable of acquiring a head-related transfer function reproducing features of a head-related transfer function of a listener without actually measuring the head-related transfer function of the listener.

According to one aspect of the present invention, there is provided a head-related transfer function generator including: an actually measured head-related impulse response acquiring unit configured to acquire data that represents an actually measured head-related impulse response of sound waves arriving at external auditory meatus entrances of a listener for training; an early head-related transfer function generating unit configured to calculate an initial head-related impulse response by applying a window function to the actually measured head-related impulse response and generate data representing an early head-related transfer function by performing a Fourier transform on the initial head-related impulse response; a frequency band dividing unit configured to divide the early head-related transfer function into a plurality of frequency bands; and a modeled head-related transfer function generating unit configured to execute a process of extracting a peak or a notch on the basis of curvature of the early head-related transfer function and a process of determining a relative amplitude for each of the plurality of frequency bands and generate data representing a modeled head-related transfer function of the listener for training by interpolating points representing the relative amplitudes.

The head-related transfer function generator according to one aspect of the present invention further includes: a pinna shape acquiring unit configured to acquire data that represents a shape of a pinna of the listener for training; a frequency band identifying unit configured to identify a first frequency band including a first notch having a lowest frequency among notches included in the modeled head-related transfer function of the listener for training and a second frequency band including a second notch having a second lowest frequency among the notches included in the modeled head-related transfer function of the listener for training; and a relation deriving unit configured to execute a first process of deriving a relation between a first scale having a correlation with a first probability corresponding to the first frequency band and the shape of the pinna of the listener for training for each of the plurality of frequency bands and execute a second process of deriving a relation between a second scale having a correlation with a second probability corresponding to the second frequency band and the shape of the pinna of the listener for training for each of the plurality of frequency bands.

According to one aspect of the present invention, in the head-related transfer function generator described above, the relation deriving unit is configured to calculate a first correlation matrix as the relation derived by the first process by executing a discriminant analysis having the shape of the pinna of the listener for training as an explanatory variable and having the plurality of frequency bands as objective variables in the first process and calculate a second correlation matrix as the relation derived by the second process by executing a discriminant analysis having the shape of the pinna of the listener for training as an explanatory variable and having the plurality of frequency bands as objective variables in the second process.

According to one aspect of the present invention, in the head-related transfer function generator described above, the relation deriving unit is configured to calculate the first scale using the first correlation matrix and the shape of the pinna of the listener for training, identify a frequency band having the highest first probability among the plurality of frequency bands as the first frequency band on the basis of the first scale, calculate the second scale using the second correlation matrix and the shape of the pinna of the listener for training, and identify a frequency band having the highest second probability among the plurality of frequency bands as the second frequency band on the basis of the second scale.

According to one aspect of the present invention, in the head-related transfer function generator described above, the relation deriving unit is configured to derive a first learned model that has been caused to learn using training data having the shape of the pinna of the listener for training as a problem and having the first frequency band as an answer as the relation derived by the first process in the first process and derive a second learned model that has been caused to learn using training data having the shape of the pinna of the listener for training as a problem and having the second frequency band as an answer as the relation derived by the second process in the second process.

According to one aspect of the present invention, in the head-related transfer function generator described above, the relation deriving unit is configured to calculate the first scale using the first learned model and the shape of the pinna of the listener for training, identify a frequency band having the highest first probability among the plurality of frequency bands as the first frequency band on the basis of the first scale, calculate the second scale using the second learned model and the shape of the pinna of the listener for training, and identify a frequency band having the highest second probability among the plurality of frequency bands as the second frequency band on the basis of the second scale.

According to one aspect of the present invention, in the head-related transfer function generator described above, the relation deriving unit is further configured to execute at least one of a first correction process of re-identifying a frequency band having a second highest first probability as the first frequency band and a second correction process of re-identifying a frequency band having a second highest second probability as the second frequency band in a case in which the number of frequency bands present between the frequency band identified as the first frequency band and the frequency band identified as the second frequency band is equal to or smaller than a predetermined lower limit threshold or equal to or larger than a predetermined upper limit threshold.

According to one aspect of the present invention, in the head-related transfer function generator described above, the relation deriving unit is configured to execute the first correction process in a case in which the number of frequency bands present between the frequency band identified as the first frequency band and the frequency band identified as the second frequency band is equal to or smaller than the predetermined lower limit threshold or equal to or larger than the predetermined upper limit threshold, and a predetermined size of the pinna of the listener for training is smaller than a first threshold.

According to one aspect of the present invention, in the head-related transfer function generator described above, the relation deriving unit is configured to execute the second correction process in a case in which the number of frequency bands present between the frequency band identified as the first frequency band and the frequency band identified as the second frequency band is equal to or smaller than the predetermined lower limit threshold or equal to or larger than the predetermined upper limit threshold, and a predetermined size of the pinna of the listener for training exceeds a second threshold.

The head-related transfer function generator according to one aspect of the present invention further includes: a pinna shape acquiring unit configured to acquire data that represents a shape of a pinna of the listener for training; a frequency band integrating unit configured to generate at least two integrated frequency bands acquired by integrating a plurality of the frequency bands; an integrated frequency band identifying unit configured to identify a first integrated frequency band including a first notch having a lowest frequency among notches included in the modeled head-related transfer function of the listener for training and a second integrated frequency band including a second notch having a second lowest frequency among notches included in the modeled head-related transfer function of the listener for training; and a relation deriving unit configured to execute a first process of deriving a relation between a first scale having a correlation with a first probability corresponding to the first integrated frequency band and the shape of the pinna of the listener for training for each of the plurality of integrated frequency bands and execute a second process of deriving a relation between a second scale having a correlation with a second probability corresponding to the second integrated frequency band and the shape of the pinna of the listener for training for each of the plurality of integrated frequency bands.

According to one aspect of the present invention, in the head-related transfer function generator described above, the relation deriving unit is configured to calculate a first correlation matrix as the relation derived by the first process by executing a discriminant analysis having the shape of the pinna of the listener for training set an explanatory variable and having the plurality of integrated frequency bands as objective variables in the first process and calculate a second correlation matrix as the relation derived by the second process by executing a discriminant analysis having the shape of the pinna of the listener for training as an explanatory variable and having the plurality of integrated frequency bands as objective variables in the second process.

According to one aspect of the present invention, in the head-related transfer function generator described above, the relation deriving unit is configured to calculate the first scale using the first correlation matrix and the shape of the pinna of the listener for training, identify an integrated frequency band having the highest first probability among the plurality of integrated frequency bands as the first integrated frequency band on the basis of the first scale, calculate the second scale using the second correlation matrix and the shape of the pinna of the listener for training, and identify an integrated frequency band having the highest second probability among the plurality of integrated frequency bands as the second integrated frequency band on the basis of the second scale.

According to one aspect of the present invention, in the head-related transfer function generator described above, the relation deriving unit is configured to derive a first learned model that has been caused to learn using training data having the shape of the pinna of the listener for training as a problem and having the first integrated frequency band as an answer as the relation derived by the first process in the first process and derive a second learned model that has been caused to learn using training data having the shape of the pinna of the listener for training as a problem and having the second integrated frequency band as an answer as the relation derived by the second process in the second process.

According to one aspect of the present invention, in the head-related transfer function generator described above, the relation deriving unit is configured to calculate the first scale using the first learned model and the shape of the pinna of the listener for training, identify an integrated frequency band having the highest first probability among the plurality of integrated frequency bands as the first integrated frequency band on the basis of the first scale, calculate the second scale using the second learned model and the shape of the pinna of the listener for training, and identify an integrated frequency band having the highest second probability among the plurality of integrated frequency bands as the second integrated frequency band on the basis of the second scale.

According to one aspect of the present invention, in the head-related transfer function generator, the pinna shape acquiring unit is further configured to acquire data that represents a shape of a pinna of a listener for inference, the head-related transfer function generator may further include a frequency band estimating unit configured to execute a third process of calculating a third scale having a correlation with a third probability corresponding to a third frequency band including a first notch having a lowest frequency among notches included in an individualized head-related transfer function of the listener for inference using the shape of the pinna of the listener for inference and the first correlation matrix and estimating a frequency band having the highest third probability as the third frequency band for each of the plurality of frequency bands and execute a fourth process of calculating a fourth scale having a correlation with a fourth probability corresponding to a fourth frequency band including a second notch having a second lowest frequency among the notches included in the individualized head-related transfer function of the listener for inference using the shape of the pinna of the listener for inference and the second correlation matrix and estimating a frequency band having the highest fourth probability as the fourth frequency band for each of the plurality of frequency bands.

According to one aspect of the present invention, in the head-related transfer function generator, the pinna shape acquiring unit is configured to acquire data representing a shape of a pinna of a listener for inference, the head-related transfer function generator may further include a frequency band estimating unit configured to execute a third process of calculating a third scale having a correlation with a third probability corresponding to a third frequency band including a first notch having a lowest frequency among notches included in an individualized head-related transfer function of the listener for inference using the shape of the pinna of the listener for inference and the first learned model and estimating a frequency band having the highest third probability as the third frequency band for each of the plurality of frequency bands and execute a fourth process of calculating a fourth scale having a correlation with a fourth probability corresponding to a fourth frequency band including a second notch having a second lowest frequency among the notches included in the individualized head-related transfer function of the listener for inference using the shape of the pinna of the listener for inference and the second learned model and estimating a frequency band having the highest fourth probability as the fourth frequency band for each of the plurality of frequency bands.

According to one aspect of the present invention, in the head-related transfer function generator described above, the frequency band estimating unit is further configured to execute at least one of a third correction process of re-estimating a frequency band having a second highest third probability as the third frequency band and a fourth correction process of re-estimating a frequency band having a second highest fourth probability as the fourth frequency band in a case in which the number of frequency bands present between the frequency band estimated as the third frequency band and the frequency band estimated as the fourth frequency band is equal to or smaller than a predetermined lower limit threshold or equal to or larger than a predetermined upper limit threshold.

According to one aspect of the present invention, in the head-related transfer function generator described above, the frequency band estimating unit is configured to execute the third correction process in a case in which the number of frequency bands present between the frequency band estimated as the third frequency band and the frequency band estimated as the fourth frequency band is equal to or smaller than a predetermined lower limit threshold or equal to or larger than a predetermined upper limit threshold, and a predetermined size of the pinna of the listener for inference is smaller than a third threshold.

According to one aspect of the present invention, in the head-related transfer function generator described above, the frequency band estimating unit is further configured to execute the fourth correction process in a case in which the number of frequency bands present between the frequency band estimated as the third frequency band and the frequency band estimated as the fourth frequency band is equal to or smaller than a predetermined lower limit threshold or equal to or larger than a predetermined upper limit threshold, and a predetermined size of the pinna of the listener for inference exceeds a fourth threshold.

According to one aspect of the present invention, in the head-related transfer function generator described above, the frequency band estimating unit may further include an individualized head-related transfer function generating unit configured to generate an individualized head-related transfer function of the listener for inference using results of estimation of the third frequency band and the fourth frequency band acquired by the frequency band estimating unit.

According to one aspect of the present invention, in the head-related transfer function generator described above, the pinna shape acquiring unit is further configured to acquire data that represents a shape of a pinna of a listener for inference, the head-related transfer function generator may further include an integrated frequency band estimating unit configured to execute a third process of calculating a third scale having a correlation with a third probability corresponding to a third integrated frequency band including a first notch having a lowest frequency among notches included in an individualized head-related transfer function of the listener for inference using the shape of the pinna of the listener for inference and the first correlation matrix and estimating an integrated frequency band having the highest third probability as the third integrated frequency band for each of the plurality of integrated frequency bands and execute a fourth process of calculating a fourth scale having a correlation with a fourth probability corresponding to a fourth integrated frequency band including a second notch having a second lowest frequency among the notches included in the individualized head-related transfer function of the listener for inference using the shape of the pinna of the listener for inference and the second correlation matrix and estimating an integrated frequency band having the highest fourth probability as the fourth integrated frequency band for each of the plurality of integrated frequency bands.

According to one aspect of the present invention, in the head-related transfer function generator described above, the pinna shape acquiring unit is further configured to acquire data that represents a shape of a pinna of a listener for inference, the head-related transfer function generator may further include an integrated frequency band estimating unit configured to execute a third process of calculating a third scale having a correlation with a third probability corresponding to a third integrated frequency band including a first notch having a lowest frequency among notches included in an individualized head-related transfer function of the listener for inference using the shape of the pinna of the listener for inference and the first learned model and estimating an integrated frequency band having the highest third probability as the third integrated frequency band for each of the plurality of integrated frequency bands and execute a fourth process of calculating a fourth scale having a correlation with a fourth probability corresponding to a fourth integrated frequency band including a second notch having a second lowest frequency among the notches included in the individualized head-related transfer function of the listener for inference using the shape of the pinna of the listener for inference and the second learned model and estimating an integrated frequency band having the highest fourth probability as the fourth integrated frequency band for each of the plurality of integrated frequency bands.

According to one aspect of the present invention, there is provided a head-related transfer function generation program causing a computer to execute: acquiring data that represents an actually measured head-related impulse response of sound waves arriving at external auditory meatus entrances of a listener for training; calculating an initial head-related impulse response by applying a window function to the actually measured head-related impulse response and generating data representing an early head-related transfer function by performing a Fourier transform on the initial head-related impulse response; dividing the early head-related transfer function into a plurality of frequency bands; and executing a process of extracting a peak or a notch on the basis of curvature of the early head-related transfer function and a process of determining a relative amplitude for each of the plurality of frequency bands and generating data representing a modeled head-related transfer function of the listener for training by interpolating points representing the relative amplitudes.

According to one aspect of the present invention, there is provided a head-related transfer function generation method including: acquiring data that represents an actually measured head-related impulse response of sound waves arriving at external auditory meatus entrances of a listener for training; calculating an initial head-related impulse response by applying a window function to the actually measured head-related impulse response and generating data representing an early head-related transfer function by performing a Fourier transform on the initial head-related impulse response; dividing the early head-related transfer function into a plurality of frequency bands; and executing a process of extracting a peak or a notch on the basis of curvature of the early head-related transfer function and a process of determining a relative amplitude for each of the plurality of frequency bands and generating data representing a modeled head-related transfer function of the listener for training by interpolating points representing the relative amplitudes.

According to the present invention, a head-related transfer function generator, a head-related transfer function generation program, and a head-related transfer function generation method capable of acquiring a head-related transfer function that reproduces features of the head-related transfer function of a listener without actually measuring the head-related transfer function of the listener can be provided.

BRIEF DESCRIPTION OF THE DRAWINGS

FIG. 23 is a diagram illustrating an example of integrated frequency bands according to the embodiment.

FIG. 24 is a diagram illustrating an example of integrated frequency bands according to the embodiment.

DETAILED DESCRIPTION OF THE INVENTION

Figure 1:
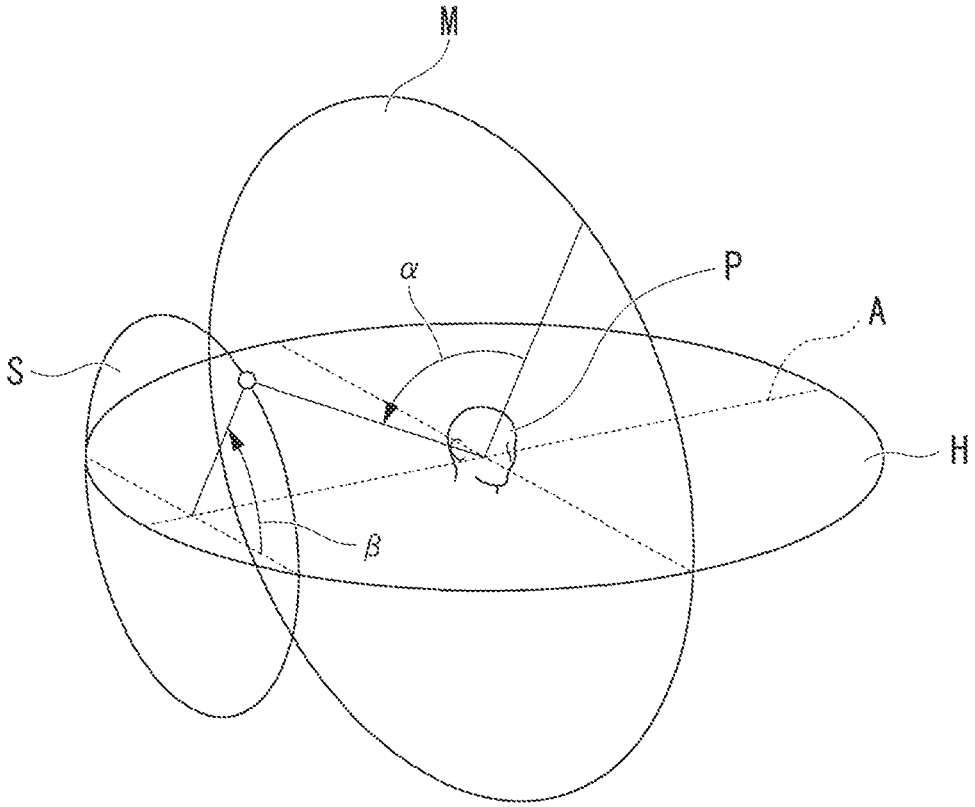
FIG. 1 is a diagram illustrating a listener and a horizontal plane, a median plane, a sagittal plane, a trunnion, a lateral angle, and a vertical angle with reference to the listener according to an embodiment.

First, a trunnion coordinate system used showing a head-related transfer function generator according to an embodiment will be described with reference to FIG. 1. FIG. 1 is a diagram illustrating a listener and a horizontal plane, a median plane, a sagittal plane, a trunnion, a lateral angle, and a vertical angle with reference to the listener according to the embodiment.

The trunnion coordinate system illustrated in FIG. 1 is defined as follows. A trunnion A is a straight line that joins left and right external auditory meatus entrances of a listener P. The origin is a center point of a segment that joins the left and right external auditory meatus entrances of the listener P and is positioned on the trunnion A. The horizontal plane H is a plane that joins a right orbital point and left and right tragi. The median plane M is a plane that is orthogonal to the horizontal plane and equally divides a listener P horizontally. The sagittal plane S is an arbitrary plane that is parallel to the median plane M. The trunnion coordinate system represents a direction in which a sound source is located using the lateral angle $\alpha$ and the vertical angle $\beta$. The lateral angle $\alpha$ is a complementary angle of an angle that is formed by a straight line joining a point at which a sound source is located and the origin with the trunnion A. The vertical angle $\beta$ is an elevation angle within the sagittal plane S that passes through a point at which a sound source is located.

Next, hardware composing the head-related transfer function generator according to an embodiment will be described with reference to FIG. 2.

Figure 2:
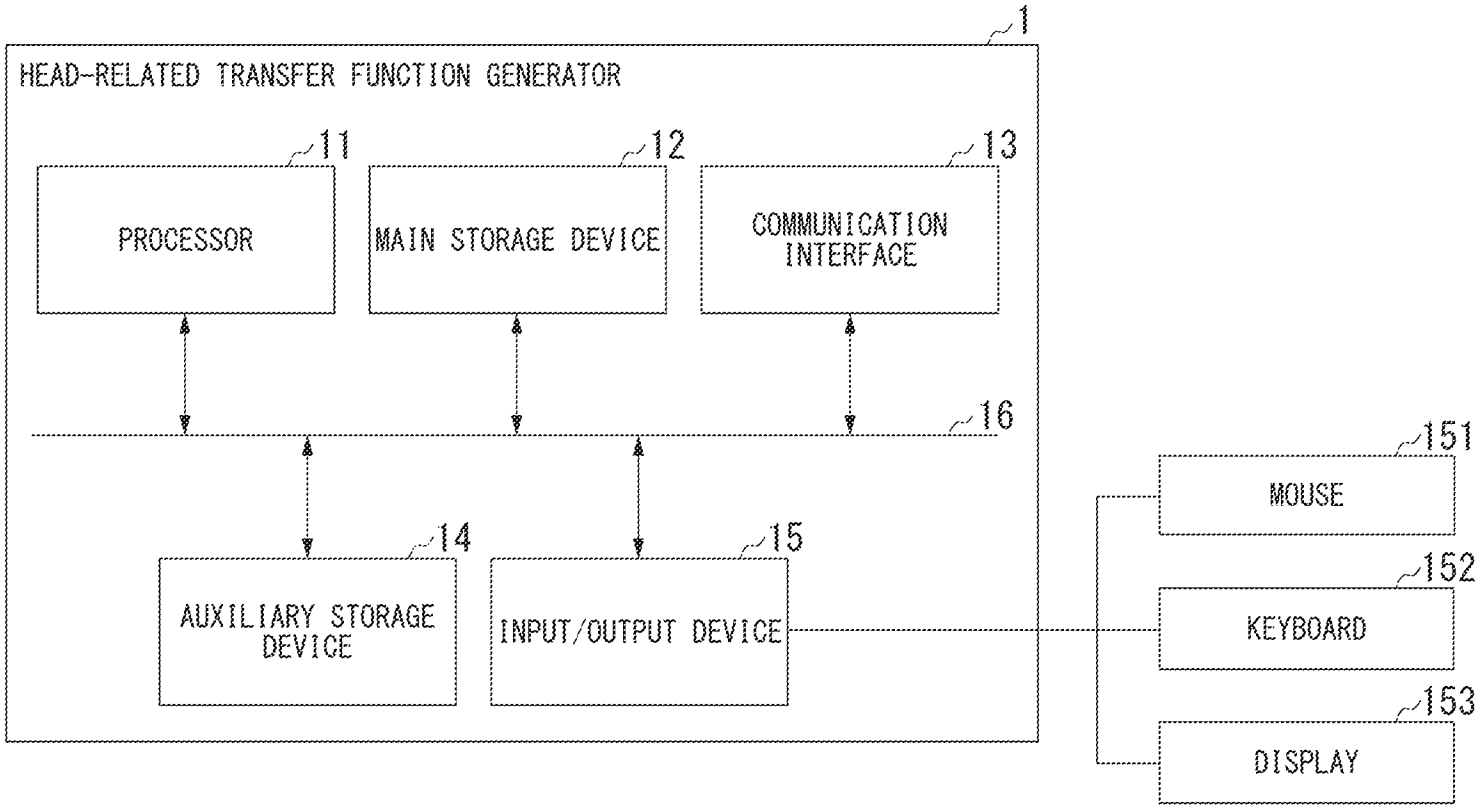
FIG. 2 is a diagram illustrating an example of hardware that composes a head-related transfer function generator according to the embodiment.

FIG. 2 is a diagram illustrating an example of the hardware that composes the head-related transfer function generator according to the embodiment. As illustrated in FIG. 2, the head-related transfer function generator 1 includes a processor 11, a main storage device 12, a communication interface 13, an auxiliary storage device 14, an input/output device 15, and a bus 16.

The processor 11 is, for example, a central processing unit (CPU) and realizes each function of the head-related transfer function generator 1 by reading and executing a head-related transfer function generation program. In addition, the processor 11 may realize functions required for realizing each function of the head-related transfer function generator 1 by reading and executing a program other than the head-related transfer function generation program.

The main storage device 12 is, for example, a random access memory (RAM) and stores a head-related transfer function generation program and other programs, which are read and executed by the processor 11, in advance.

The communication interface 13 is an interface circuit that is used for communicating with other devices through a network. For example, the network is the Internet, an intranet, a wide area network (WAN), or a local area network (LAN).

For example, the auxiliary storage device 14 is a hard disk drive (HDD), a solid state drive (SSD), a flash memory, or a read only memory (ROM).

For example, the input/output device 15 is an input/output port. For example, a mouse 151, a keyboard 152, and a display 153 illustrated in FIG. 2 are connected to the input/output device 15. For example, the mouse 151 and the keyboard 152 are used for operations of inputting data required for operating the head-related transfer function generator 1. For example, the display 153 is a liquid crystal display. The display 153 is, for example, a graphical user interface (GUI) of the head-related transfer function generator 1 and displays contents illustrated in FIG. 8 to be described below and the like.

The bus 16 connects the processor 11, the main storage device 12, the communication interface 13, the auxiliary storage device 14, and the input/output device 15 such that data thereof can be transmitted and received.

Next, the functional configuration of the head-related transfer function generator according to the embodiment will be described with reference to FIGS. 3 to 24.

Figure 3:
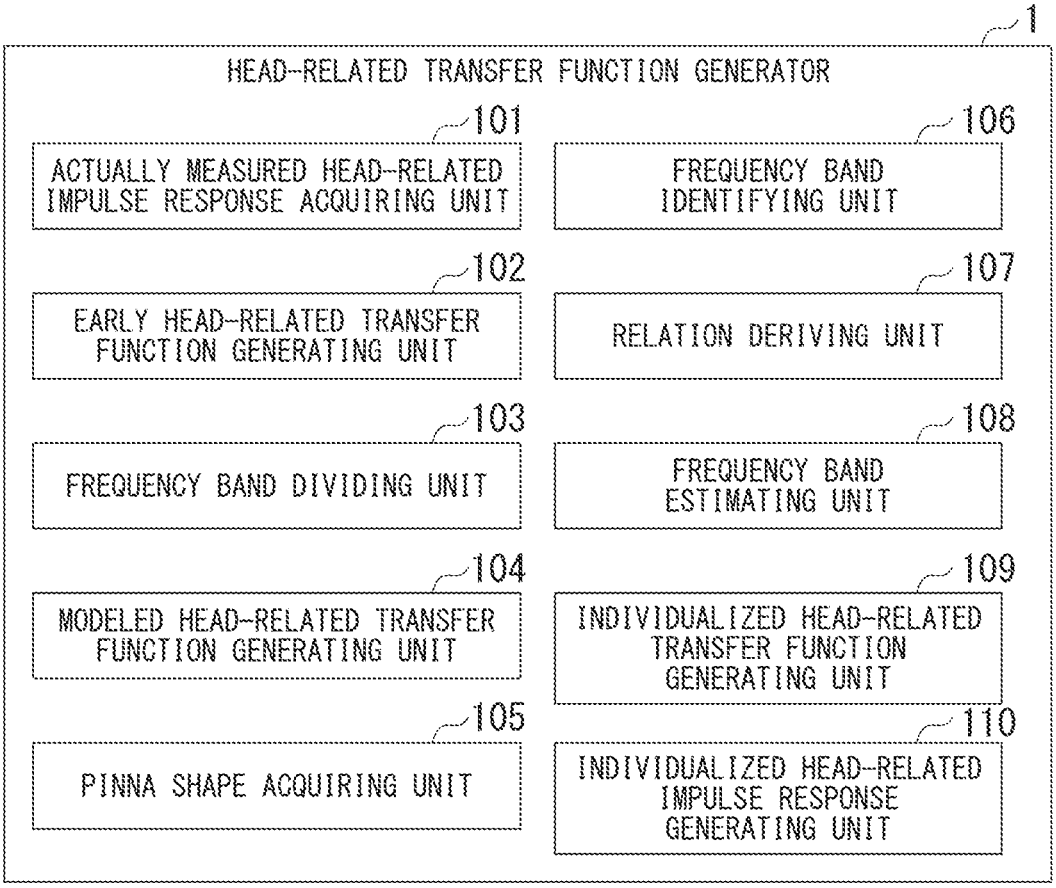
FIG. 3 is a diagram illustrating an example of the functional configuration of the head-related transfer function generator according to the embodiment.

FIG. 3 is a diagram illustrating an example of the functional configuration of the head-related transfer function generator according to the embodiment. As illustrated in FIG. 3, the head-related transfer function generator 1 includes an actually measured head-related impulse response acquiring unit 101, an early head-related transfer function generating unit 102, a frequency band dividing unit 103, a modeled head-related transfer function generating unit 104, a pinna shape acquiring unit 105, a frequency band identifying unit 106, a relation deriving unit 107, a frequency band estimating unit 108, an individualized head-related transfer function generating unit 109, and an individualized head-related impulse response generating unit 110.

Figure 4:
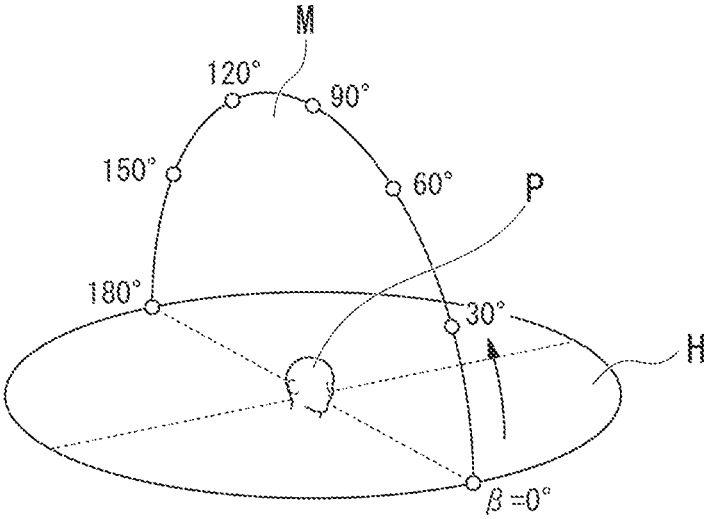
FIG. 4 is a diagram illustrating a listener and vertical angles in the median plane cut by 30 degrees with reference to the listener according to the embodiment.

The actually measured head-related impulse response acquiring unit 101 acquires data that represents an actually measured head-related impulse response of sound waves that have arrived at the external auditory meatus entrance of a listener for training. FIG. 4 is a diagram illustrating a listener and vertical angles in the median plane cut by 30 degrees with reference to the listener according to the embodiment. For example, the actually measured head-related impulse response acquiring unit 101 acquires data representing an actually measured head-related impulse response of sound waves that have arrived at the external auditory meatus entrances of the listener P from a sound source disposed in a direction in which the vertical angle β in the median plane M is 0 degrees, 30 degrees, 60 degrees, 90 degrees, 120 degrees, 150 degrees, or 180 degrees. As illustrated in FIG. 4, a direction in which the vertical angle β is 0 degrees coincides with a front direction of the listener P. In addition, as illustrated in FIG. 4, a direction in which the vertical angle β is 180 degrees coincides with a direction opposite to the front direction of the listener P.

Figure 5:
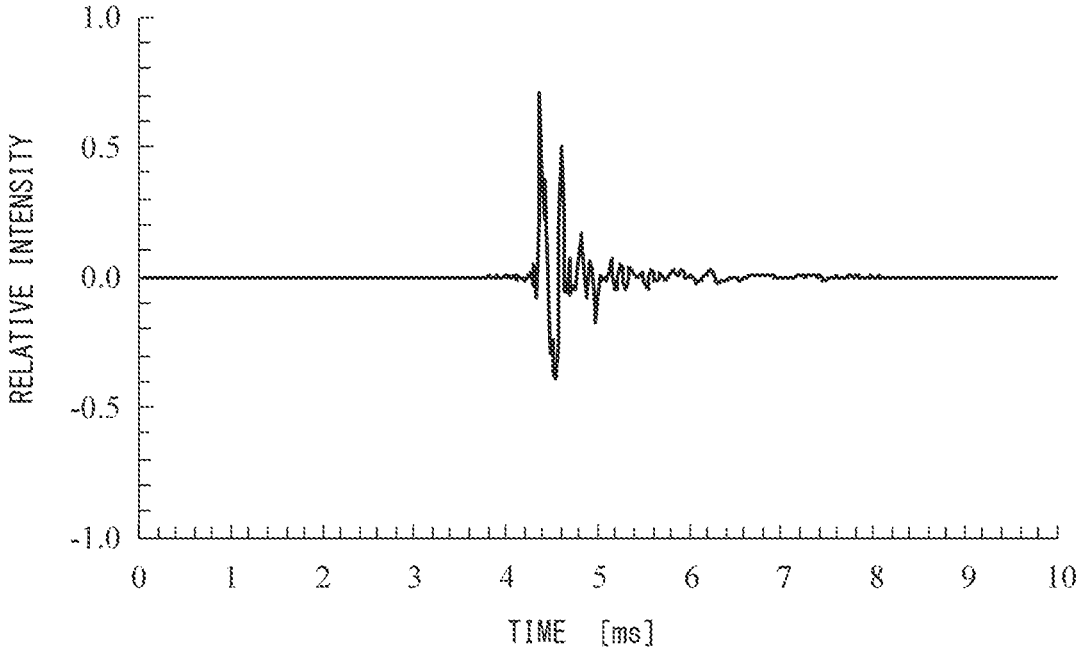
FIG. 5 is a diagram illustrating an example of an actually measured head-related impulse response according to the embodiment.

FIG. 5 is a diagram illustrating an example of an actually measured head-related impulse response according to the embodiment. Ahead-related impulse response (HRIR) represents a change of a physical characteristic according to sound waves arriving at the external auditory meatus entrances of a listener from a sound source being influenced by a head part of a listener and the periphery thereof in a time domain. The actually measured head-related impulse response is a head-related impulse response generated by actually measuring sound waves. As illustrated in FIG. 5, the actually measured head-related impulse response represents changes in the relative intensity of sound waves that have arrived at the external auditory meatus entrance of a listener over time.

The actually measured head-related impulse response is transformed into an actually measured head-related transfer function through a Fourier transform. The head-related transfer function (HRTF) represents changes in physical characteristics of sound waves, which have arrived at the external auditory meatus entrances of a listener from a sound source, by being influenced by a head part of the listener and the periphery thereof in a frequency domain. The actually measured head-related transfer function is a head-related transfer function generated by actually measuring sound waves.

Figure 6:
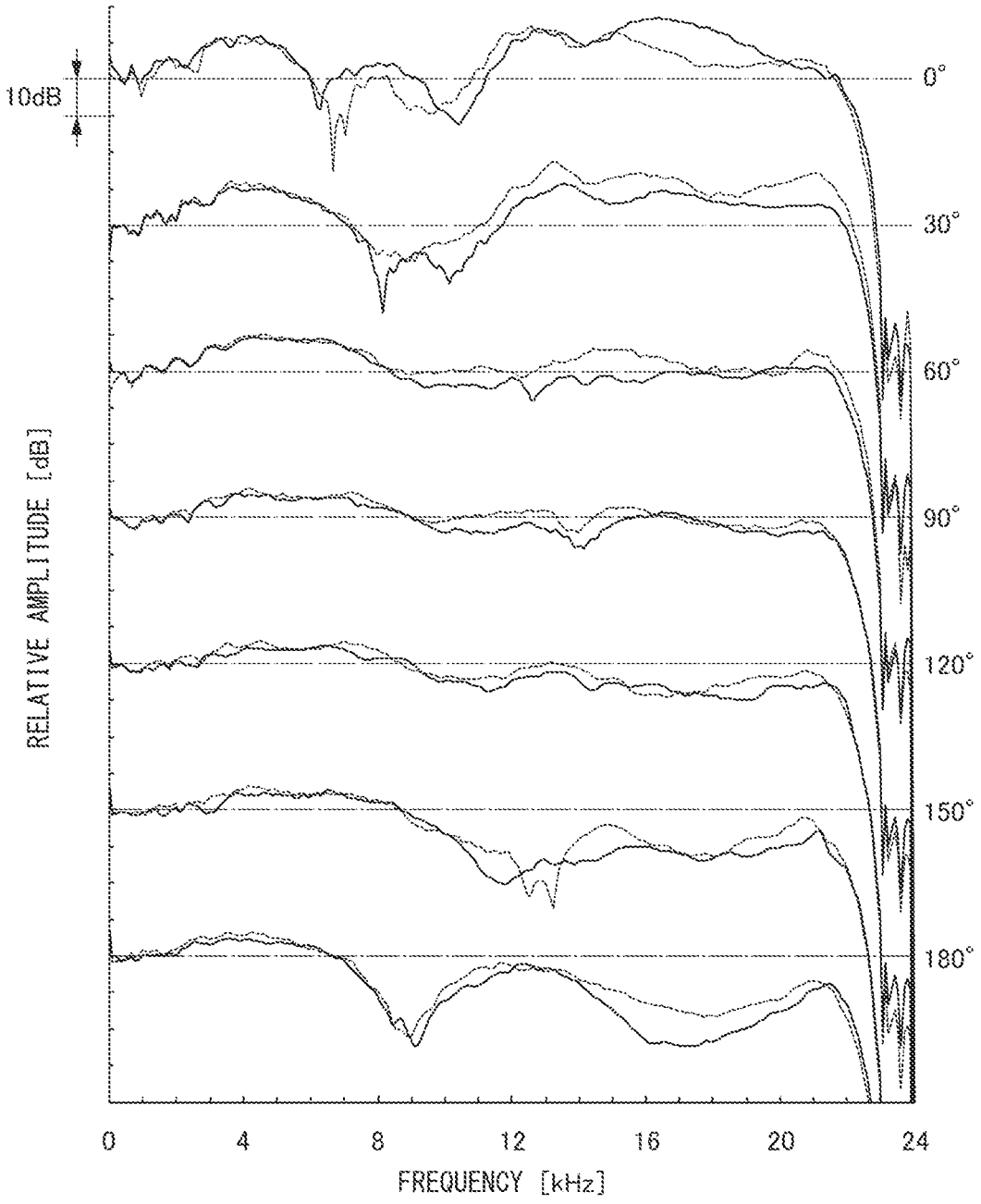
FIG. 6 is a diagram illustrating an example of an actually measured head-related transfer function of a right ear and a head-related transfer function of a left ear of a listener according to the embodiment.

FIG. 6 is a diagram illustrating an example of an actually measured head-related transfer function of a right ear and a head-related transfer function of a left ear of a listener according to the embodiment. In FIG. 6, the horizontal axis represents a frequency of sound waves output from a sound source, and the vertical axis represents a relative amplitude of sound waves arriving at the right ear or the left ear of the listener. As the relative amplitude described here, by using an amplitude observed in a case in which a microphone is present at a position of the right ear or the left ear of a listener and the listener is not present as a reference, an amplitude increasing from this amplitude in accordance with the presence of a head part, a body part, and the like of the listener is represented as a positive quantity, and an amplitude decreasing from this amplitude in accordance with the presence of the head part, the body part, and the like of the listener is represented as a negative quantity. In FIG. 6, the reference is denoted by a dashed dotted line.

In FIG. 6, a solid line represents an actually measured head-related transfer function that is generated by performing a Fourier transform on an actually measured head-related impulse response of sound waves incident on the right ear of the listener. In addition, in FIG. 6, a broken line represents an actually measured head-related transfer function that is generated by performing a Fourier transform on an actually measured head-related impulse response of sound waves incident on the left ear of the listener. From the top of FIG. 6, a first stage, a second stage, a third stage, a fourth stage, a fifth stage, a sixth stage, and a seventh stage respectively represent actually measured head-related transfer functions of sound waves arriving at the external auditory meatus entrance of the listener from sound sources disposed in the directions in which the vertical angles β in the median plane M are 0 degrees, 30 degrees, 60 degrees, 90 degrees, 120 degrees, 150 degrees, and 180 degrees.

As illustrated in FIG. 6, the head-related transfer function is different in accordance with a direction in which a sound source is located and is also different between the right ear and the left ear of the listener. The reason for this is that the shape of the head part, the shape of the body, and the shape of the pinna of a listener are asymmetric in any one of a forward/backward direction, a left/right direction, and an upward/downward direction with reference to the listener. For this reason, the head-related transfer function becomes a clue in a case in which a direction in which a sound source is located is perceived by a listener.

In addition, the head-related transfer function of a listener in a case in which a sound source is located in a specific direction causes the listener to perceive a sound image located in the specific direction. The sound image is a whole body perceived by a listener in a case in which sound waves arrive at an eardrum of the listener and is a psychological image felt by the listener according to the perception. For example, the sound image includes a time property such as a reverberation feeling, a sense of rhythm, and a sustaining feeling, a spatial property such as a direction feeling, a distance feeling, and an expanse feeling, and a quality property such as a magnitude, a height, and a tone. The listener's perception of a spatial position of a sound image will be referred to as sound image localization.

The head-related transfer function causes a listener to perceive a sound image, and thus, in a case in which the head-related transfer function is appropriately reproduced, it is a significant concept for realizing a three-dimensional acoustic system, virtual reality of sounds, and the like. However, a difference of the head-related transfer function for each listener becomes a hurdle for realizing such a technology.

Figure 7:
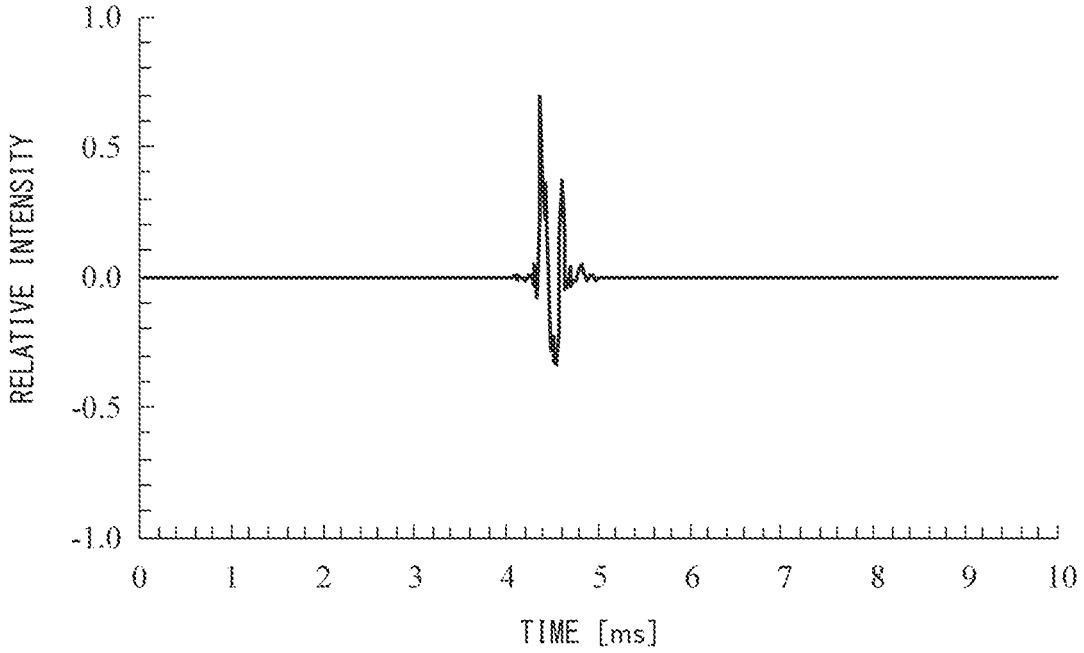
FIG. 7 is a diagram illustrating an example of an initial head-related impulse response according to the embodiment.

The early head-related transfer function generating unit 102 calculates an initial head-related impulse response by applying a window function to the actually measured head-related impulse response. The window function described here is, for example, a Blackman-Harris window and is a step function extracting only a period until a predetermined time elapses from a maximum peak of a relative intensity included in the actually measured head-related impulse response. FIG. 7 is a diagram illustrating an example of the initial head-related impulse response according to the embodiment. In FIG. 7, the horizontal axis represents time, and the vertical axis represents a relative intensity. For example, the early head-related transfer function generating unit 102 calculates the initial head-related impulse response illustrated in FIG. 7 by applying a predetermined window function to the head-related impulse response illustrated in FIG. 5.

Figure 8:
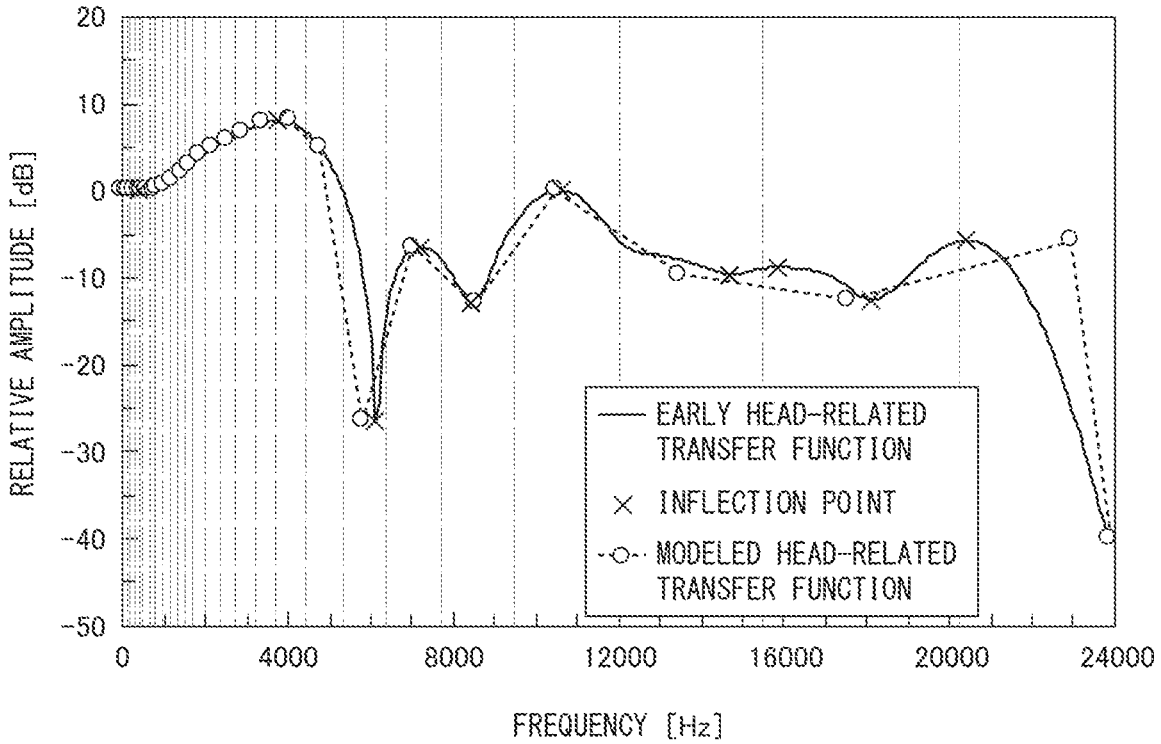
FIG. 8 is a diagram illustrating an example of an early head-related transfer function, a frequency band, and a modeled head-related transfer function according to the embodiment.

Then, the early head-related transfer function generating unit 102 performs a Fourier transform on the initial head-related impulse response, thereby generating data representing the early head-related transfer function. FIG. 8 is a diagram illustrating an example of an early head-related transfer function, a frequency band, and a modeled head-related transfer function according to the embodiment. For example, the early head-related transfer function generating unit 102 generates data representing an early head-related transfer function denoted by a solid line in FIG. 8. In a case in which the early head-related transfer function is calculated using a window function extracting a time until about one millisecond elapses from a maximum peak of the relative intensity included in the actually measured head-related impulse response, it frequently becomes a smooth head-related transfer function having relatively little noise.

The frequency band dividing unit 103 divides the early head-related transfer function into a plurality of frequency bands. For example, the frequency band dividing unit 103 divides the early head-related transfer function denoted by the solid line in FIG. 8 into frequency bands denoted by a dashed-dotted line in FIG. 8. Each frequency band is a band between dashed-dotted lines adjacent to each other illustrated in FIG. 8.

The modeled head-related transfer function generating unit 104 executes a process of extracting a peak or a notch on the basis of the curvature of the early head-related transfer function for each of a plurality of frequency bands. A peak represents an upwardly convex part in the head-related transfer function. A notch represents a downwardly convex part in the head-related transfer function.

Next, the modeled head-related transfer function generating unit 104 executes a process of determining a relative amplitude on the basis of the curvature of the early head-related transfer function for each of the plurality of frequency bands. For example, the modeled head-related transfer function generating unit 104, first, searches for inflection points included in each frequency band. In a case in which one inflection point is found in the frequency band, the modeled head-related transfer function generating unit 104 determines a relative amplitude represented by the inflection point as the relative amplitude of the frequency band. On the other hand, in a case in which two or more inflection points are found in the frequency band, the modeled head-related transfer function generating unit 104 determines a maximum relative amplitude among relative amplitudes represented by such inflection points as the relative amplitude of the frequency band. In addition, in a case in which no inflection point is found in the frequency band, the modeled head-related transfer function generating unit 104 determines a relative amplitude at the center frequency of the frequency band as the relative amplitude of the frequency band.

Then, the modeled head-related transfer function generating unit 104 interpolates points representing relative amplitudes of the frequency bands, thereby generating data representing an individualized head-related transfer function of the listener. For example, the modeled head-related transfer function generating unit 104 joins such points using segments, thereby generating data representing an individualized head-related transfer function denoted by a broken line in FIG. 8.

In addition, the modeled head-related transfer function generating unit 104 reproduces the early head-related transfer function with different accuracies in accordance with a width of the frequency band set by the frequency band dividing unit 103. Next, a relation between the width of frequency bands and the reproduction accuracy of the early head-related transfer function will be described with reference to FIGS. 9 to 13.

Figure 9:
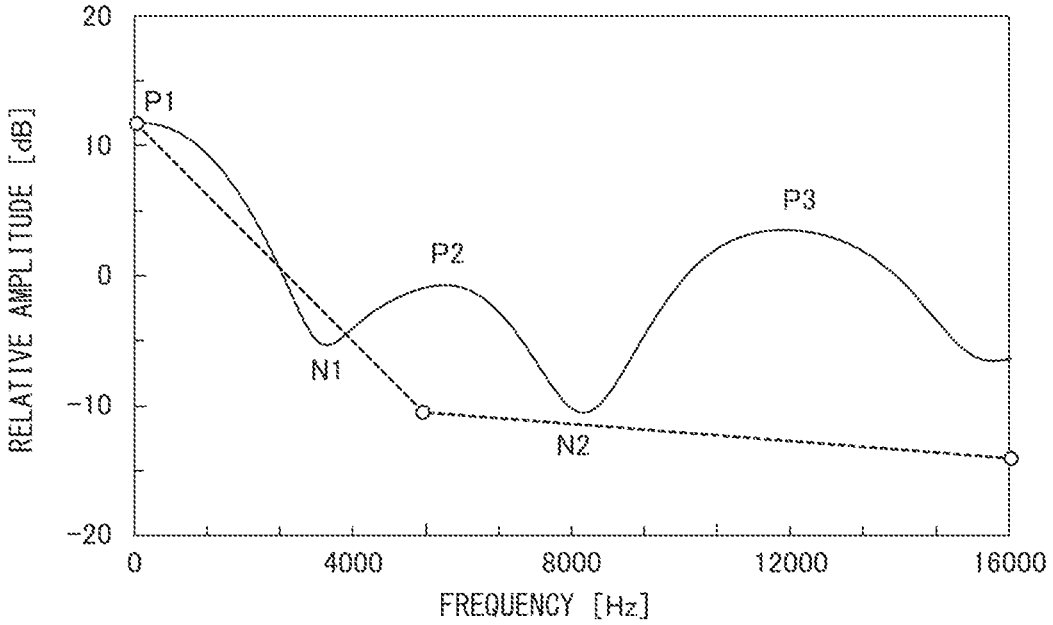
FIG. 9 is a diagram illustrating an example of an early head-related transfer function and a modeled head-related transfer function generated through division into frequency bands for each octave according to the embodiment.

FIG. 9 is a diagram illustrating an example of an early head-related transfer function and a modeled head-related transfer function generated through division into frequency bands of each octave according to the embodiment. In FIG. 9, a solid line represents an early head-related transfer function, and a broken line represents a modeled head-related transfer function generated through division into frequency bands of each octave.

As illustrated in FIG. 9, in a case in which the early head-related transfer function is divided into frequency bands of each octave, the modeled head-related transfer function generating unit 104 cannot reproduce a peak P2, a peak P3, a first notch N1, and a second notch N2 included in the early head-related transfer function using the modeled head-related transfer function. The first notch N1 and the second notch N2 achieve important roles in a case in which a listener perceives a vertical angle in a direction in which a sound image is located within the median plane.

Figure 10:
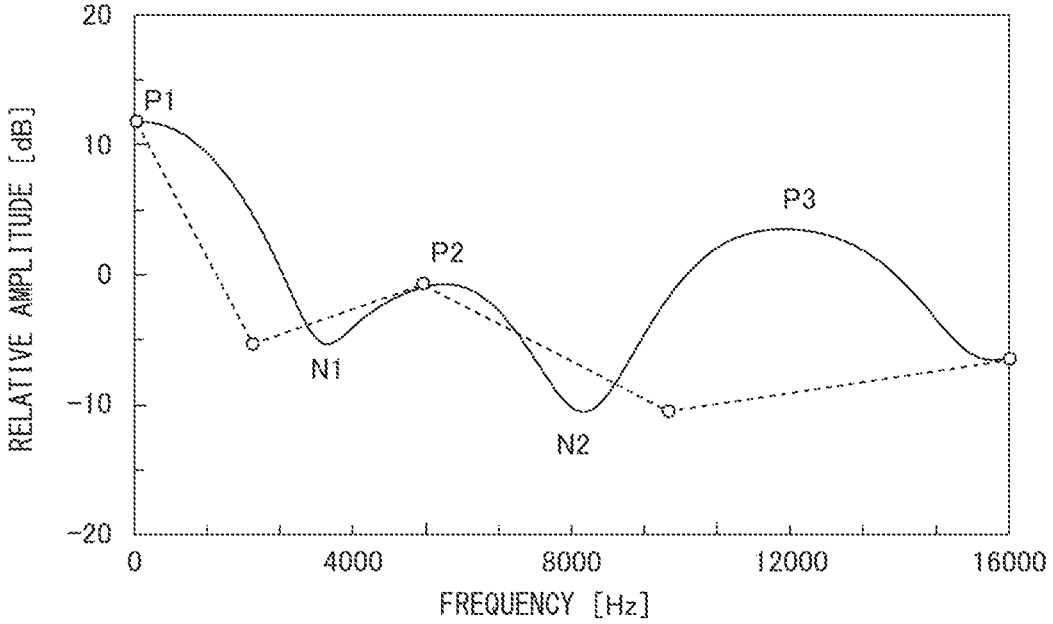
FIG. 10 is a diagram illustrating an example of an early head-related transfer function and a modeled head-related transfer function generated through division into frequency bands of each ½ octave according to the embodiment.

FIG. 10 is a diagram illustrating an example of an early head-related transfer function and a modeled head-related transfer function generated through division into frequency bands of each ½ octave according to the embodiment. In FIG. 10, a solid line represents an early head-related transfer function, and a broken line represents a modeled head-related transfer function generated through division into frequency bands of each ½ octave.

As illustrated in FIG. 10, in a case in which the early head-related transfer function is divided into frequency bands of each ½ octave, the modeled head-related transfer function generating unit 104 reproduces the peak P2, the first notch N1, and the second notch N2 included in the early head-related transfer function to a certain degree. However, in this case, a frequency at which the peak P2 becomes a maximum, a frequency at which the first notch N1 becomes a minimum, and a frequency at which the second notch N2 becomes a minimum in the modeled head-related transfer function are greatly different from such frequencies in the early head-related transfer function. In addition, in this case, the modeled head-related transfer function generating unit 104 cannot reproduce the peak P3 included in the early head-related transfer function.

Figure 11:
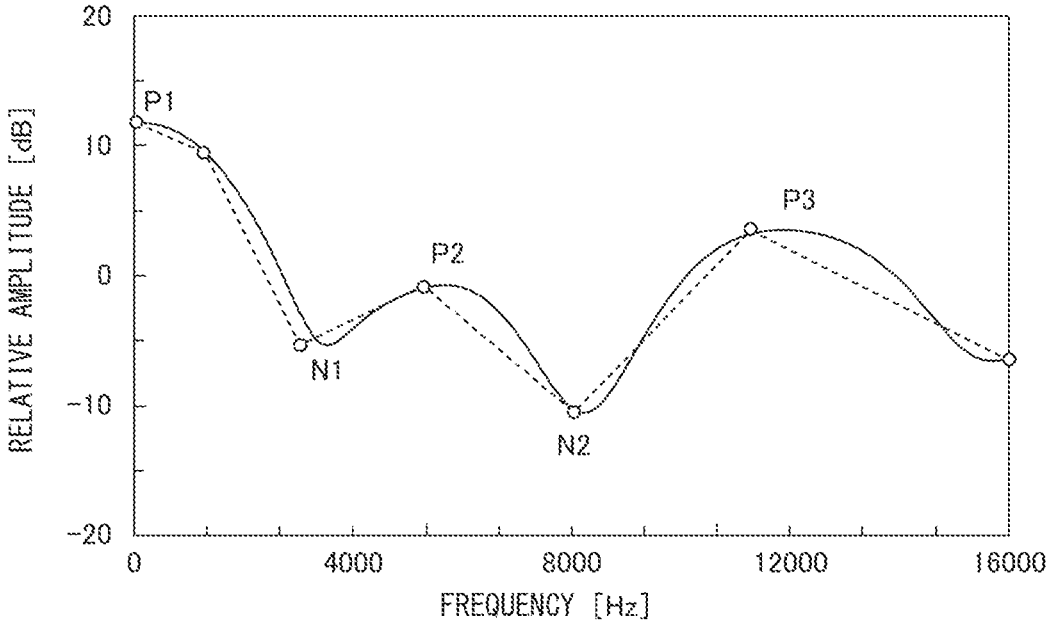
FIG. 11 is a diagram illustrating an example of an early head-related transfer function and a modeled head-related transfer function generated through division into frequency bands of each ⅓ octave according to the embodiment.

FIG. 11 is a diagram illustrating an example of an early head-related transfer function and a modeled head-related transfer function generated through division into frequency bands of each ⅓ octave according to the embodiment. In FIG. 11, a solid line represents an early head-related transfer function, and a broken line represents a modeled head-related transfer function generated through division into frequency bands of each ⅓ octave.

As illustrated in FIG. 11, in a case in which the early head-related transfer function is divided into frequency bands of each ⅓ octave, the modeled head-related transfer function generating unit 104 reproduces the peak P2, the peak P3, the first notch N1, and the second notch N2 included in the early head-related transfer function to a certain degree. However, in this case, a frequency at which the peak P2 becomes a maximum, a frequency at which the peak P3 becomes a maximum, a frequency at which the first notch N1 becomes a minimum, and a frequency at which the second notch N2 becomes a minimum in the modeled head-related transfer function are slightly different from such frequencies in the early head-related transfer function.

Figure 12:
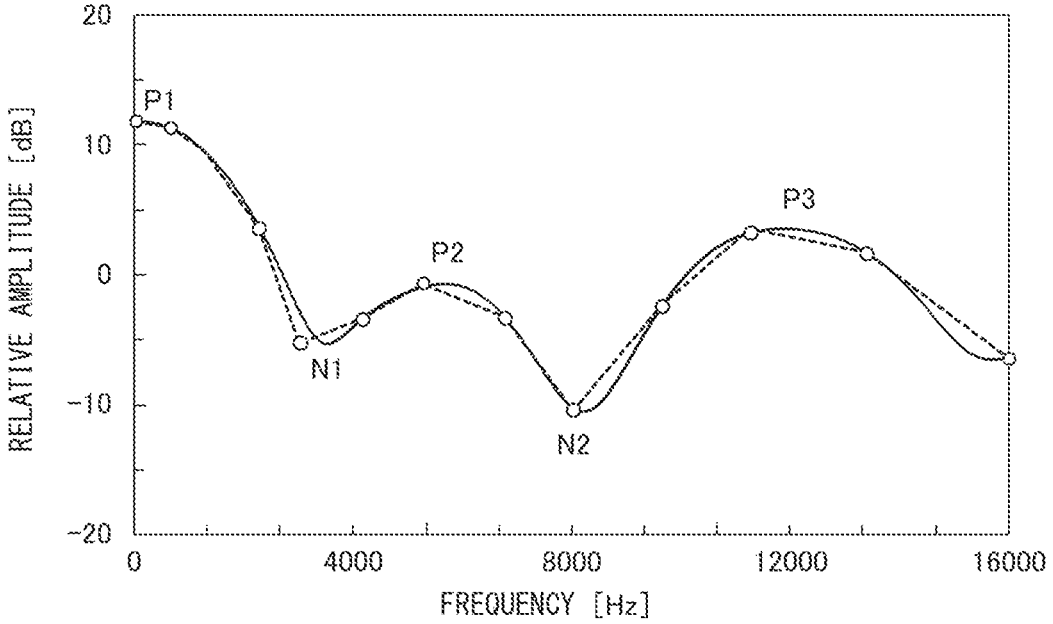
FIG. 12 is a diagram illustrating an example of an early head-related transfer function and a modeled head-related transfer function generated through division into frequency bands of each ⅙ octave according to the embodiment.

FIG. 12 is a diagram illustrating an example of an early head-related transfer function and a modeled head-related transfer function generated through division into frequency bands of each ⅙ octave according to the embodiment. In FIG. 12, a solid line represents an early head-related transfer function, and a broken line represents a modeled head-related transfer function generated through division into frequency bands of each ⅙ octave.

As illustrated in FIG. 12, in a case in which the early head-related transfer function is divided into frequency bands of each ⅙ octave, the modeled head-related transfer function generating unit 104 reproduces the peak P2, the peak P3, the first notch N1, and the second notch N2 included in the early head-related transfer function with relatively high accuracy.

Figure 13:
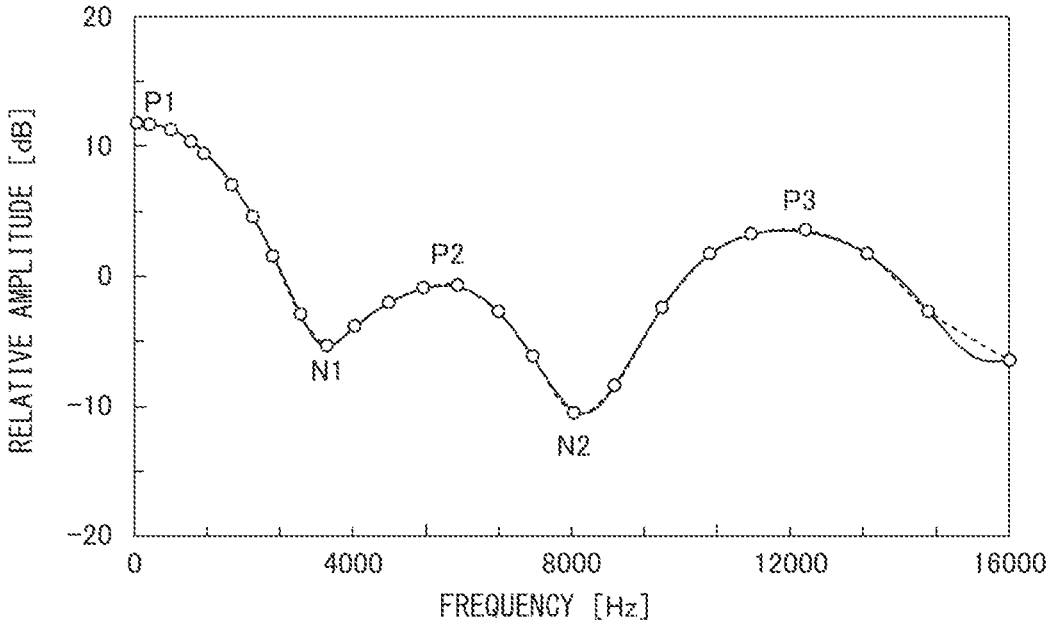
FIG. 13 is a diagram illustrating an example of an early head-related transfer function and a modeled head-related transfer function generated through division into frequency bands of each 1/12 octave according to the embodiment.

FIG. 13 is a diagram illustrating an example of an early head-related transfer function and a modeled head-related transfer function generated through division into frequency bands of each 1/12 octave according to the embodiment. In FIG. 13, a solid line represents an early head-related transfer function, and a broken line represents a modeled head-related transfer function generated through division into frequency bands of each 1/12 octave.

As illustrated in FIG. 13, in a case in which the early head-related transfer function is divided into frequency bands of each 1/12 octave, the modeled head-related transfer function generating unit 104 reproduces the peak P2, the peak P3, the first notch N1, and the second notch N2 included in the early head-related transfer function with relatively high accuracy.

The reproduction accuracy of the early head-related transfer function using the modeled head-related transfer function generating unit 104 has an influence on listener's sound image localization. Thus, the influence of the reproduction accuracy of the early head-related transfer function on listener's sound image localization will be described with reference to FIGS. 14 to 19.

Figure 14:
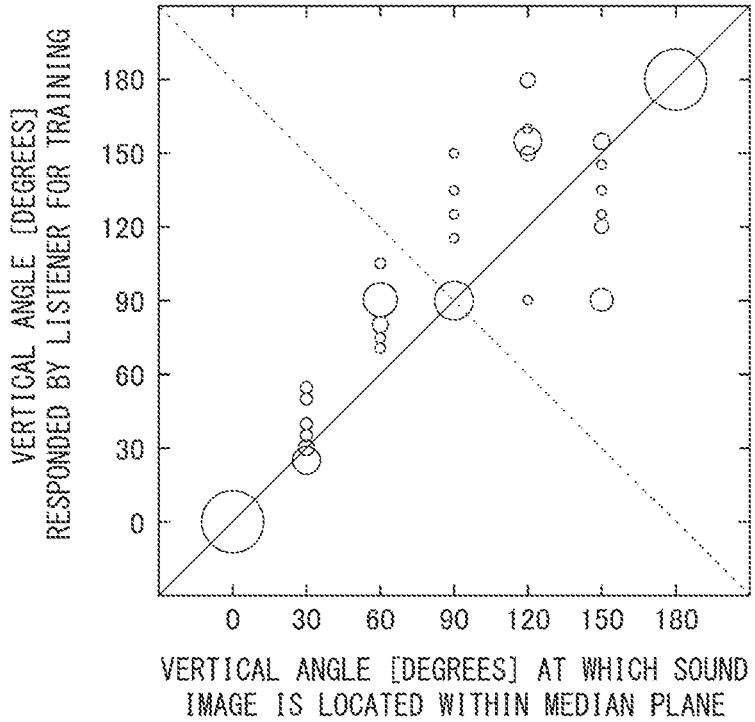
FIG. 14 is a diagram illustrating an example of a relation between a direction of a sound image and a direction responded by a listener for training in a sound image localization test using an actually measured head-related transfer function.

FIG. 14 is a diagram illustrating an example of a relation between a direction of a sound image and a direction responded by a listener for training in a sound image localization test using an actually measured head-related transfer function. In FIG. 14, the horizontal axis represents a vertical angle at which a sound image is located within a median plane, and the vertical axis represents a vertical angle responded by the listener for training. As illustrated in FIG. 14, in a case in which the actually measured head-related transfer function is used, it can be understood that the vertical angle at which the sound image is located within the median plane and the vertical angle responded by the listener approximately coincide with each other.

Figure 15:
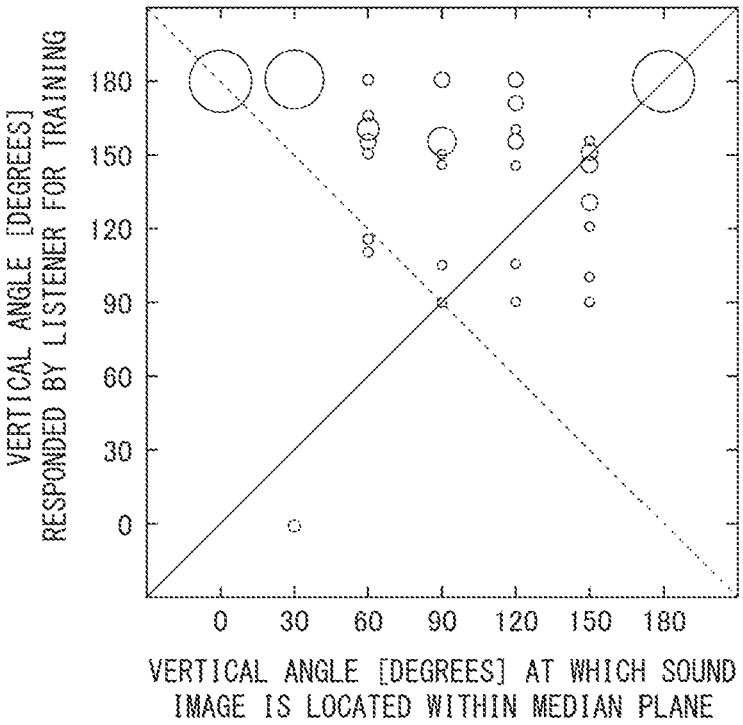
FIG. 15 is a diagram illustrating an example of a relation between a direction of a sound image and a direction responded by a listener for training in a sound image localization test using a modeled head-related transfer function generated through division into a frequency band of each octave.

FIG. 15 is a diagram illustrating an example of a relation between a direction of a sound image and a direction responded by a listener for training in a sound image localization test using a modeled head-related transfer function generated through division into a frequency band of each octave. In FIG. 15, the horizontal axis represents a vertical angle at which a sound image is located within a median plane, and the vertical axis represents a vertical angle responded by the listener for training. As illustrated in FIG. 15, in a case in which the modeled head-related transfer function generated through division into frequency bands of each octave is used, it can be understood that a case in which the vertical angle responded by the listener for training does not coincide with the vertical angle at which a sound image is located frequently occurs in the range of 0 degrees to 150 degrees.

Figure 16:
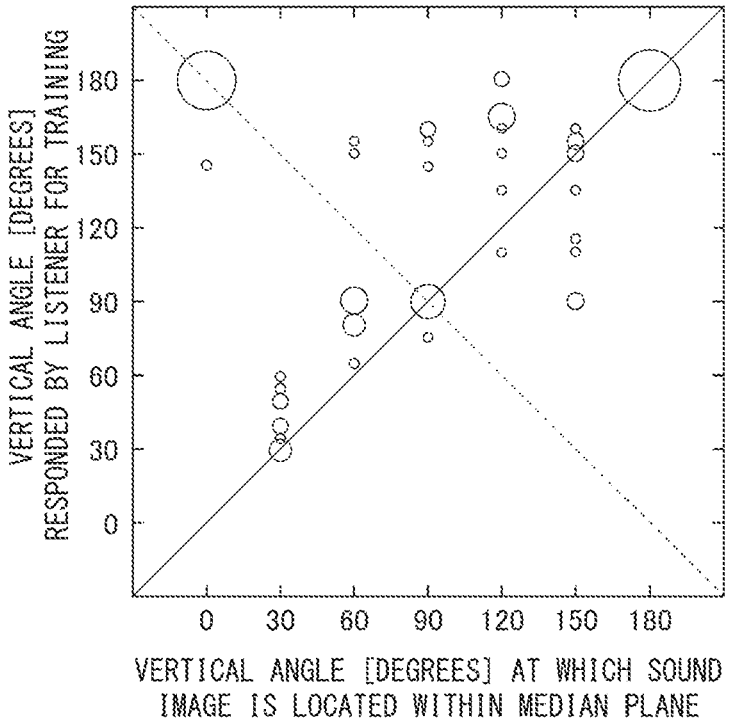
FIG. 16 is a diagram illustrating an example of a relation between a vertical angle at which a sound image is positioned and a vertical angle responded by a listener for training in a sound image localization test using a modeled head-related transfer function generated through division into a frequency band of each ½ octave.

FIG. 16 is a diagram illustrating an example of a relation between a vertical angle at which a sound image is positioned and a vertical angle responded by a listener for training in a sound image localization test using a modeled head-related transfer function generated through division into a frequency band of each ½ octave. In FIG. 16, the horizontal axis represents a vertical angle at which a sound image is located within a median plane, and the vertical axis represents a vertical angle responded by the listener for training. As illustrated in FIG. 16, in a case in which the modeled head-related transfer function generated through division into frequency bands of each ½ octave is used, it can be understood that a case in which the vertical angle responded by the listener for training does not coincide with the vertical angle at which a sound image is located frequently occurs in the range of 0 degrees to 150 degrees.

Figure 17:
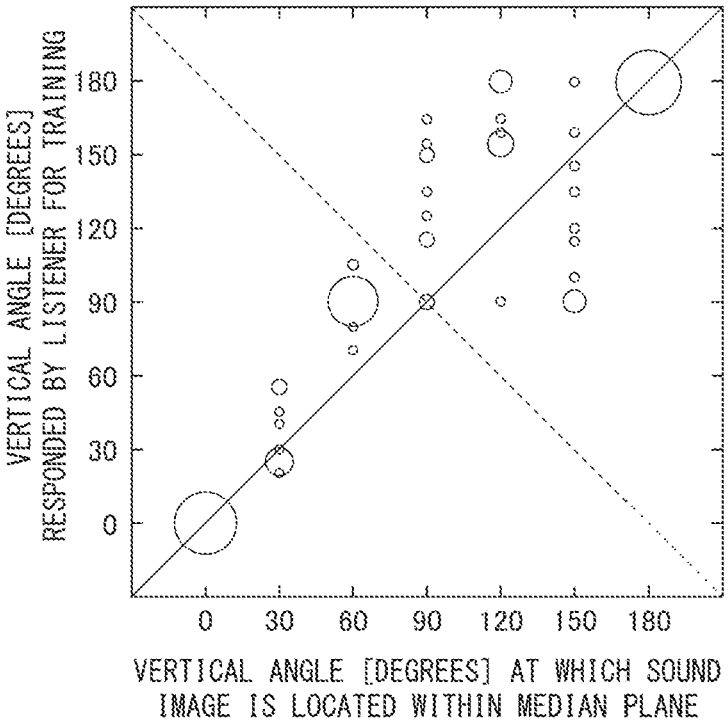
FIG. 17 is a diagram illustrating an example of a relation between a vertical angle at which a sound image is positioned and a vertical angle responded by a listener for training in a sound image localization test using a modeled head-related transfer function generated through division into a frequency band of each ⅓ octave.

FIG. 17 is a diagram illustrating an example of a relation between a vertical angle at which a sound image is positioned and a vertical angle responded by a listener for training in a sound image localization test using a modeled head-related transfer function generated through division into a frequency band of each ⅓ octave. In FIG. 17, the horizontal axis represents a vertical angle at which a sound image is located within a median plane, and the vertical axis represents a vertical angle responded by the listener for training. As illustrated in FIG. 17, in a case in which the modeled head-related transfer function generated through division into frequency bands of each ⅓ octave is used, it can be understood that, although a case in which the vertical angle responded by the listener for training does not coincide with the vertical angle at which a sound image is located is occasionally found in the range of 90 degrees to 150 degrees, both vertical angles coincide with each other on the whole.

Figure 18:
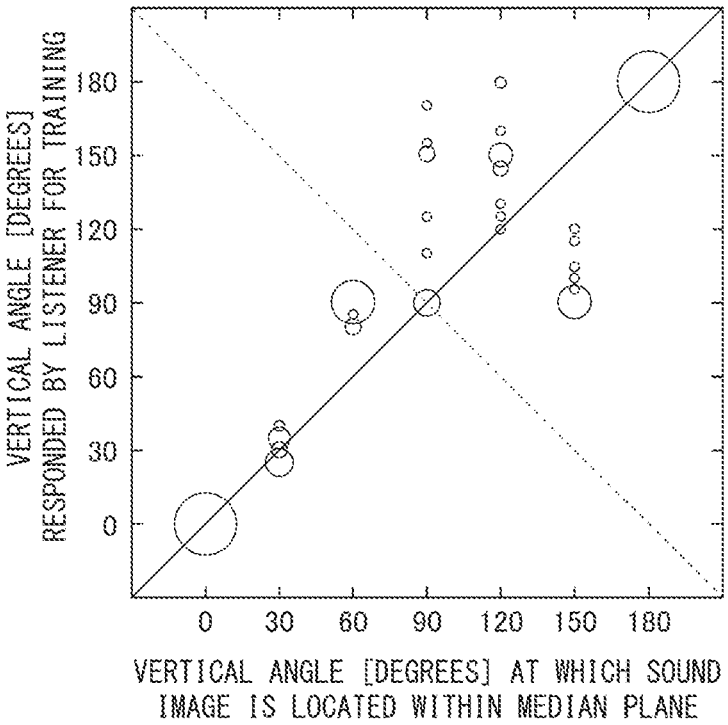
FIG. 18 is a diagram illustrating an example of a relation between a vertical angle at which a sound image is positioned and a vertical angle responded by a listener for training in a sound image localization test using a modeled head-related transfer function generated through division into a frequency band of each ⅙ octave.

FIG. 18 is a diagram illustrating an example of a relation between a vertical angle at which a sound image is positioned and a vertical angle responded by a listener for training in a sound image localization test using a modeled head-related transfer function generated through division into a frequency band of each ⅙ octave. In FIG. 18, the horizontal axis represents a vertical angle at which a sound image is located within a median plane, and the vertical axis represents a vertical angle responded by the listener for training. As illustrated in FIG. 18, in a case in which the modeled head-related transfer function generated through division into frequency bands of each ⅙ octave is used, it can be understood that, although a case in which the vertical angle responded by the listener for training does not coincide with the vertical angle at which a sound image is located is occasionally found in the range of 90 degrees to 150 degrees, both vertical angles coincide with each other on the whole.

Figure 19:
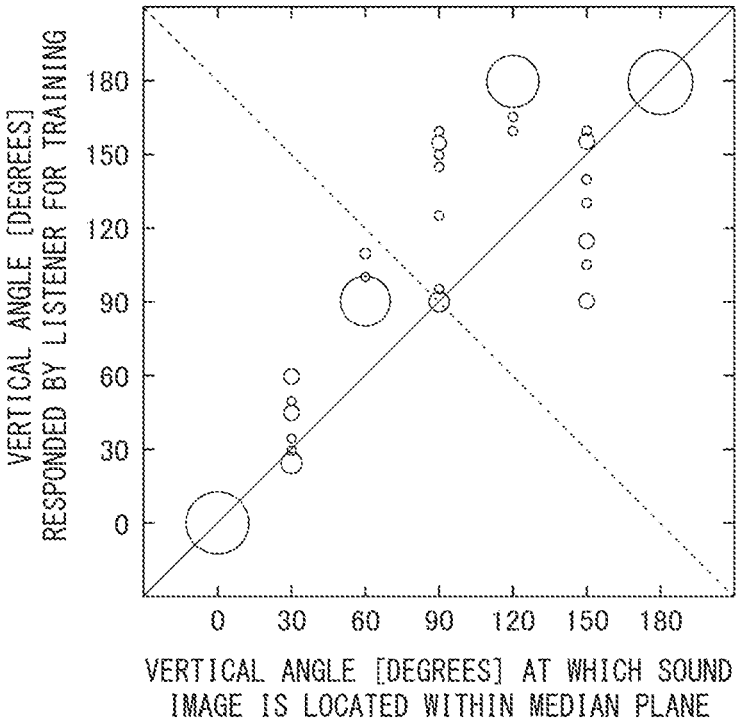
FIG. 19 is a diagram illustrating an example of a relation between a vertical angle at which a sound image is positioned and a vertical angle responded by a listener for training in a sound image localization test using a modeled head-related transfer function generated through division into a frequency band of each 1/12 octave.

FIG. 19 is a diagram illustrating an example of a relation between a vertical angle at which a sound image is positioned and a vertical angle responded by a listener for training in a sound image localization test using a modeled head-related transfer function generated through division into a frequency band of each 1/12 octave. In FIG. 19, the horizontal axis represents a vertical angle at which a sound image is located within a median plane, and the vertical axis represents a vertical angle responded by the listener for training. As illustrated in FIG. 19, in a case in which the modeled head-related transfer function generated through division into frequency bands of each 1/12 octave is used, it can be understood that, although a case in which the vertical angle responded by the listener for training does not coincide with the vertical angle at which a sound image is located is occasionally found in the range of 90 degrees to 150 degrees, both vertical angles coincide with each other on the whole.

Thus, the width of frequency bands set by the frequency band dividing unit 103 is preferably 1/12 octave to 1/3 octave and is more preferably 1/12 octave to 1/6 octave. In accordance with this, the peak P2, the peak P3, the first notch N1 and the second notch N2 illustrated in FIGS. 9 to 13 are included in mutually-different frequency bands, and thus, the modeled head-related transfer function generating unit 104 can reproduce a feature structure of the early head-related transfer function with relatively high accuracy.

Next, a process for deriving a relation between a frequency band including a first notch and the shape of a pinna of a listener for training and a process for deriving a relation between a frequency band including a second notch and the shape of the pinna of the listener for training using the head-related transfer function generator 1 will be described.

Figure 20:
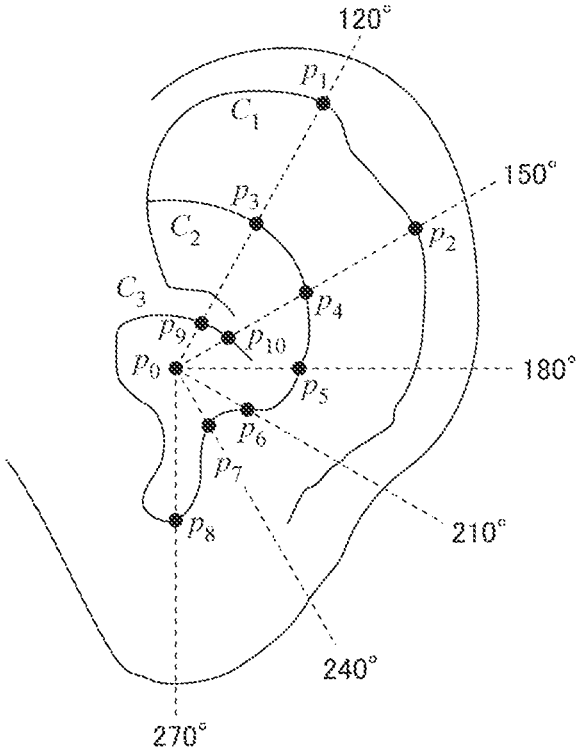
FIG. 20 is a diagram illustrating an example of positions that are measurement targets in the shape of a pinna of a listener for training according to the embodiment.

The pinna shape acquiring unit 105 acquires data that represents the shape of the pinna of a listener. FIG. 20 is a diagram illustrating an example of positions that are measurement targets in the shape of a pinna of a listener for training according to the embodiment.

For example, the pinna shape acquiring unit 105 acquires data that represents the coordinates of a point $p_1$ to a point $p_{10}$ illustrated in FIG. 20. A point $p_0$ is a point on an external auditory meatus entrance and is defined as the origin of polar coordinates. A curve $C_1$, a curve $C_2$, and a curve $C_3$ illustrated in FIG. 20 respectively represent an inner boundary line of a helix, a line along an antihelix, and an outer boundary line of a concha. All of 120 degrees to 270 degrees illustrated in FIG. 20 are vertical angles. As illustrated in FIG. 20, the point $p_1$ to the point $p_{10}$ are intersections between the curve $C_1$, the curve $C_2$, or the curve $C_3$ and one of straight lines passing through the point $p_0$ and are located on the polar coordinates described above. For example, the point $p_1$ to the point $p_{10}$ are determined using a photograph of a profile of the listener for training.

The frequency band identifying unit 106 identifies a first frequency band including a first notch and a second frequency band including a second notch. The first notch is a notch having a lowest frequency among notches included in a modeled head-related transfer function of the listener for training. The second notch is a notch having a second lowest frequency among the notches included in the modeled head-related transfer function of the listener for training.

The relation deriving unit 107 executes a first process of deriving a relation between a first scale having a correlation with a first probability corresponding to a first frequency band and the shape of the pinna of the listener for training for each of a plurality of frequency bands.

For example, in the first process, the relation deriving unit 107 executes a discriminant analysis having the shape of the pinna of the listener for training as an explanatory variable and having a plurality of frequency bands as objective variables, thereby calculating a first correlation matrix as a relation derived by the first process. The first correlation matrix is calculated for each frequency band. In addition, in this case, the first scale is a Mahalanobis distance or a value calculated using the Mahalanobis distance. The Mahalanobis distance is a product of a row vector in which parameters relating to the shape of the pinna of the listener for training are aligned, the first correlation matrix, and a column vector in which the parameters relating to the shape of the pinna of the listener for training are aligned.

In addition, the relation deriving unit 107 calculates a first scale using the first correlation matrix and the shape of the pinna of the listener for training and identifies a frequency band having the highest first probability among the plurality of frequency bands as a first frequency band on the basis of the first scale.

Furthermore, the relation deriving unit 107 executes a second process of deriving a relation between a second scale, which has a correlation with a second probability corresponding to a second frequency band, and the shape of the pinna of the listener for training for each of the plurality of frequency bands.

For example, in the second process, the relation deriving unit 107 executes a discriminant analysis having the shape of the pinna of the listener for training as an explanatory variable and having a plurality of frequency bands as objective variables, thereby calculating a second correlation matrix as a relation derived by the second process. The second correlation matrix is calculated for each frequency band. In addition, in this case, the second scale is a Mahalanobis distance or a value calculated using the Mahalanobis distance. The Mahalanobis distance is a product of a row vector in which parameters relating to the shape of the pinna of the listener for training are aligned, the second correlation matrix, and a column vector in which the parameters relating to the shape of the pinna of the listener for training are aligned.

In addition, the relation deriving unit 107 calculates a second scale using the second correlation matrix and the shape of the pinna of the listener for training and identifies a frequency band having the highest second probability among the plurality of frequency bands as a second frequency band on the basis of the second scale.

In addition, in a case in which the number of frequency bands present between a frequency band identified as the first frequency band and a frequency band identified as the second frequency band is equal to or smaller than a predetermined lower limit threshold or equal to or larger than a predetermined upper limit threshold, the relation deriving unit 107 may execute at least one of a first correction process and a second correction process. For example, the predetermined lower limit threshold described here is "3". In addition, for example, the predetermined upper limit threshold described here is "8". The first correction process is a process of re-identifying a frequency band having a second highest first probability as a first frequency band. In addition, the second correction process is a process of re-identifying a frequency band having a second highest second probability as a second frequency band.

Both the frequency band in which the first notch is included and the frequency band in which the second notch is included are over a range of about one octave, and parts thereof overlap each other. For this reason, by executing at least one of the first correction process and the second correction process, the relation deriving unit 107 can identify the first frequency band and the second frequency band with higher accuracy.

In addition, in a case in which the number of frequency bands present between a frequency band identified as the first frequency band and a frequency band identified as the second frequency band is equal to or smaller than a predetermined lower limit threshold or equal to or larger than a predetermined upper limit threshold, and a predetermined size of the pinna of the listener for training is smaller than a first threshold, the relation deriving unit 107 may execute the first correction process. The reason for this is that, in a case in which the pinna of the listener is small, the frequency band identified first as the first frequency band is incorrect in many cases.

Furthermore, in a case in which the number of frequency bands present between a frequency band identified as the first frequency band and a frequency band identified as the second frequency band is equal to or smaller than a predetermined lower limit threshold or equal to or larger than a predetermined upper limit threshold, and a predetermined size of the pinna of the listener for training exceeds a second threshold, the relation deriving unit 107 may execute the second correction process. The reason for this is that, in a case in which the pinna of the listener is large, the frequency band identified first as the second frequency band is incorrect in many cases.

Next, a process in which the head-related transfer function generator 1 estimates a frequency band including a first notch of the individualized head-related transfer function of a listener for inference and a frequency band including a second notch of the individualized head-related transfer function of the listener for inference using the shape of the pinna of the listener for inference, the relation derived by the first process, and the relation derived by the second process will be described.

The pinna shape acquiring unit 105 acquires data that represents the shape of the pinna of the listener for inference. For example, the data is data that is similar to the data described with reference to FIG. 20.

The frequency band estimating unit 108 executes a third process. More specifically, the frequency band estimating unit 108 calculates a third scale that has a correlation with a third probability corresponding to a third frequency band including a first notch having the lowest frequency among notches included in the individualized head-related transfer function of the listener for inference using the shape of the pinna of the listener for inference and the first correlation matrix for each of a plurality of frequency bands. Then, the frequency band estimating unit 108 estimates the frequency band having the highest third probability as a third frequency band.

In addition, the frequency band estimating unit 108 executes a fourth process. More specifically, the frequency band estimating unit 108 calculates a fourth scale having a correlation with a fourth probability corresponding to a fourth frequency band including a second notch having a second lowest frequency among notches included in the individualized head-related transfer function of the listener for inference using the shape of the pinna of the listener for inference and the second correlation matrix for each of a plurality of frequency bands. Then, the frequency band estimating unit 108 estimates a frequency band having the highest fourth probability as a fourth frequency band.

For example, in a case in which the third frequency band and the fourth frequency band are estimated, the frequency band estimating unit 108 uses the following Equation (1). Equation (1) represents that a product of a row vector having parameters $x_1$, $x_2$, $x_3$, $x_4$, $x_5$, $x_6$, $x_7$, $x_8$, $x_9$, and $x_{10}$ representing shapes of the pinna of the listener for inference as its elements, a column vector having these as its elements, and an inverse matrix of a correlation matrix having a correlation coefficient $r_{j,k}$ of $x_j$ (here, j=1, 2, 3, . . . , 10) and $x_k$ (here, k=1, 2, 3 . . . 10) as its elements is equal to the square of the Mahalanobis distance D. The inverse matrix of the matrix included in Equation (1) is an example of the first correlation matrix and the second correlation matrix described above. In addition, the Mahalanobis distance included in Equation (1) is an example of the first scale and the second scale described above. For example, the frequency band estimating unit 108 estimates a frequency band for which the Mahalanobis distance is a minimum as a first frequency band and estimates a frequency band for which the Mahalanobis distance is a minimum as a second frequency band.

$$D^2 = [x_1\ x_2 \ldots x_9\ x_{10}] \begin{bmatrix} r_{1,1} & \cdots & r_{1,10} \\ \vdots & \ddots & \vdots \\ r_{10,1} & \cdots & r_{10,10} \end{bmatrix}^{-1} \begin{bmatrix} x_1 \\ x_2 \\ \vdots \\ x_9 \\ x_{10} \end{bmatrix} \quad (1)$$

In addition, in a case in which the number of frequency bands present between a frequency band estimated as the third frequency band and a frequency band estimated as the fourth frequency band is equal to or smaller than a predetermined lower limit threshold or equal to or larger than a predetermined upper limit threshold, the frequency band estimating unit 108 may execute at least one of a third correction process and a fourth correction process. For example, the predetermined lower limit threshold described here is "3". In addition, for example, the predetermined upper limit threshold described here is "8". The third correction process is a process of re-estimating a frequency band having a second highest third probability as a third frequency band. In addition, the fourth correction process is a process of re-estimating a frequency band having a second highest fourth probability as a fourth frequency band. For example, the frequency band estimating unit 108 re-estimates a frequency band of which the Mahalanobis distance calculated using Equation (1) is a second largest as the third frequency band or the fourth frequency band.

Also for the individualized head-related transfer function, similar to the modeled head-related transfer function, both the frequency band in which the first notch is included and the frequency band in which the second notch is included are over a range of about one octave, and parts thereof overlap each other. For this reason, by executing at least one of the third correction process and the fourth correction process, the frequency band estimating unit 108 can identify the third frequency band and the fourth frequency band with higher accuracy.

In addition, in a case in which the number of frequency bands present between a frequency band estimated as the third frequency band and a frequency band estimated as the fourth frequency band is equal to or smaller than a predetermined lower limit threshold or equal to or larger than a predetermined upper limit threshold, and a predetermined size of the pinna of the listener for inference is smaller than a third threshold, the frequency band estimating unit 108 may execute the third correction process. The reason for this is that, in a case in which the pinna of the listener for inference is small, the frequency band estimated first as the third frequency band is incorrect in many cases.

Furthermore, in a case in which the number of frequency bands present between a frequency band estimated as the third frequency band and a frequency band estimated as the fourth frequency band is equal to or smaller than a predetermined lower limit threshold or equal to or larger than a predetermined upper limit threshold, and a predetermined size of the pinna of the listener for inference exceeds a fourth threshold, the frequency band estimating unit 108 may execute the fourth correction process. The reason for this is that, in a case in which the pinna of the listener is large, the frequency band identified first as the fourth frequency band is incorrect in many cases.

Figure 21:
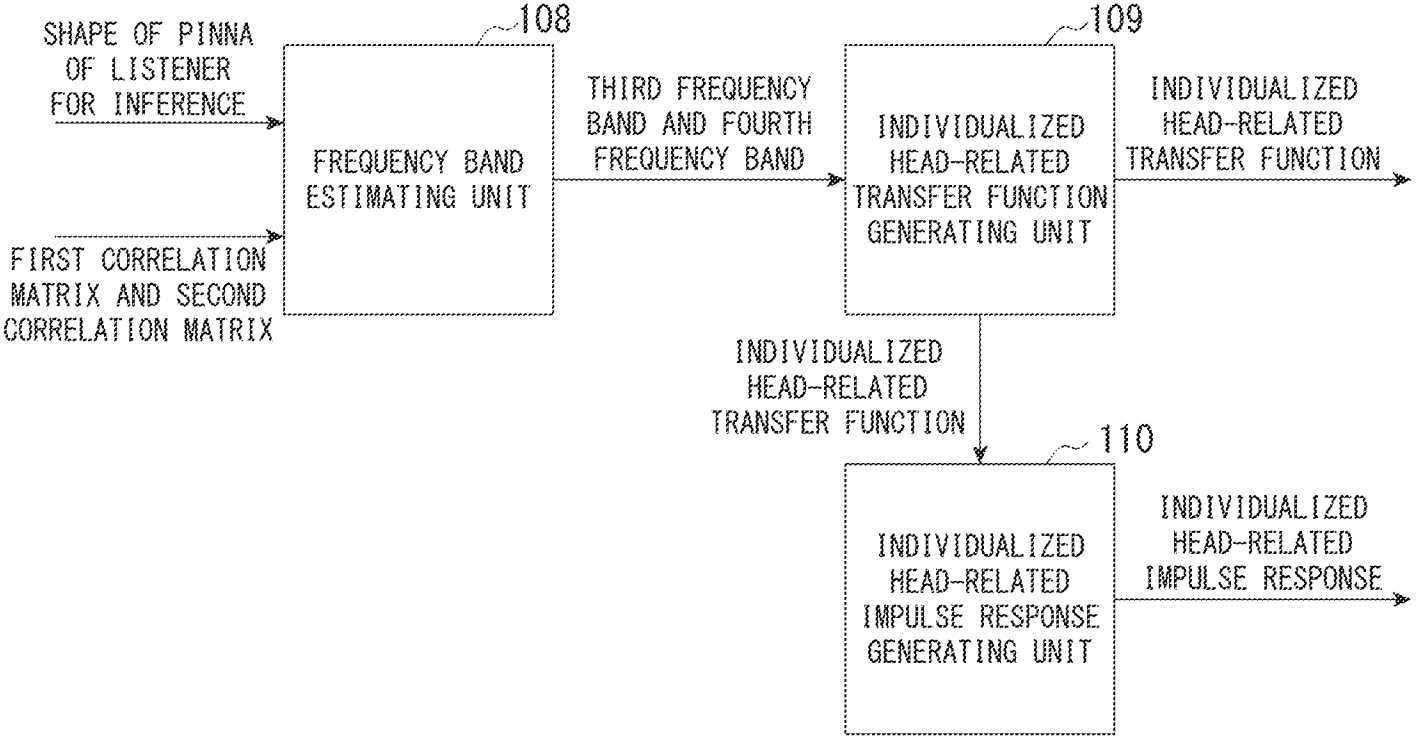
FIG. 21 is a conceptual diagram illustrating an example of a process in which a head-related transfer function generator according to the embodiment generates an individualized head-related transfer function and an individualized head-related impulse response.

Next, an example of a process in which the head-related transfer function generator 1 generates an individualized head-related transfer function and an individualized head-related impulse response will be described with reference to FIG. 21. FIG. 21 is a conceptual diagram illustrating an example of a process in which the head-related transfer function generator according to the embodiment generates an individualized head-related transfer function and an individualized head-related impulse response.

The individualized head-related transfer function generating unit 109 generates an individualized head-related transfer function of a listener for inference using results of estimation of the third frequency band and the fourth frequency band performed by the frequency band estimating unit 108.

More specifically, as illustrated in FIG. 21, the individualized head-related transfer function generating unit 109 acquires data representing the third frequency band and data representing the fourth frequency band estimated by the frequency band estimating unit 108 on the basis of the shape of the pinna of the listener for inference, the first correlation matrix, and the second correlation matrix.

Then, the individualized head-related transfer function generating unit 109 interpolates, for example, a point representing a frequency and a relative amplitude of a first peak, a point representing a center frequency and a relative amplitude of a third frequency band, a point representing a frequency and a relative amplitude of a second peak, a point representing a center frequency and a relative amplitude of a fourth frequency band through linear interpolation or the like, thereby generating an individualized head-related transfer function of the listener for inference. The first peak is a peak that appears in a frequency area lower than the first notch. The second peak is a peak that appears in a frequency area higher than the first notch and lower than the second notch. The individualized head-related transfer function generating unit 109 outputs data representing the individualized head-related transfer function to the individualized head-related impulse response generating unit 110 and outside of the head-related transfer function generator 1.

As illustrated in FIG. 21, the individualized head-related impulse response generating unit 110 performs an inverse Fourier transform on the individualized head-related transfer function generated by the individualized head-related transfer function generating unit 109, thereby generating an individualized head-related impulse response. In addition, the individualized head-related impulse response generating unit 110 outputs data representing the individualized head-related impulse response to outside of the head-related transfer function generator 1.

Next, a case in which the head-related transfer function generator according to the embodiment generates and uses an integrated frequency band acquired by integrating at least two frequency bands described above will be described with reference to FIGS. 22 to 24. Description of details that are duplicates of the details described with reference to FIGS. 1 to 21 will be omitted as is appropriate.

Figure 22:
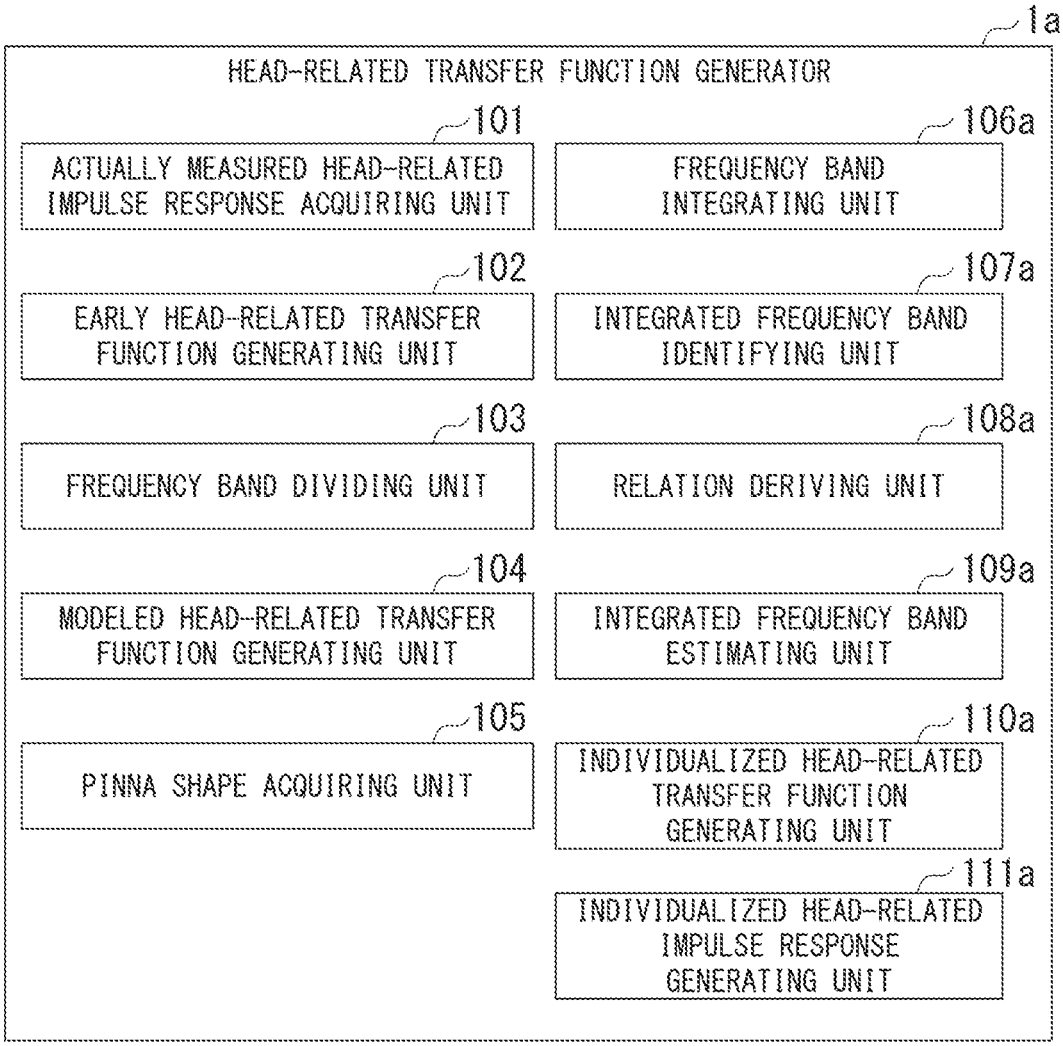
FIG. 22 is a diagram illustrating an example of the functional configuration of a head-related transfer function generator according to the embodiment.

FIG. 22 is a diagram illustrating an example of the functional configuration of a head-related transfer function generator according to the embodiment. As illustrated in FIG. 22, the head-related transfer function generator 1*a* includes the actually measured head-related impulse response acquiring unit 101, the early head-related transfer function generating unit 102, the frequency band dividing unit 103, the modeled head-related transfer function generating unit 104, the pinna shape acquiring unit 105, a frequency band integrating unit 106*a*, an integrated frequency band identifying unit 107*a*, a relation deriving unit 108*a*, an integrated frequency band estimating unit 109*a*, an individualized head-related transfer function generating unit 110*a*, and an individualized head-related impulse response generating unit 111*a*.

The frequency band integrating unit 106*a* generates at least two integrated frequency bands acquired by integrating a plurality of frequency bands. FIGS. 23 and 24 are diagrams illustrating examples of integrated frequency bands according to the embodiment.

For example, the frequency band integrating unit 106*a* selects a frequency band denoted by a number "42" in FIG. 23 and integrates the selected frequency band with a frequency band that is adjacent to the frequency band and is denoted by a number "41" in FIG. 23 and a frequency band that is adjacent to the frequency band and is denoted by a number "43" in FIG. 23. In this way, the frequency band integrating unit 106*a* generates an integrated frequency band denoted by a number "1" in FIG. 23.

For example, the frequency band integrating unit 106*a* selects a frequency band denoted by a number "45" in FIG. 23 and integrates the selected frequency band with a frequency band that is adjacent to the frequency band and is denoted by a number "44" in FIG. 23 and a frequency band that is adjacent to the frequency band and is denoted by a number "46" in FIG. 23. In this way, the frequency band integrating unit 106*a* generates an integrated frequency band denoted by a number "2" in FIG. 23.

In addition, for example, the frequency band integrating unit 106*a* selects a frequency band denoted by a number "48" in FIG. 24 and integrates the selected frequency band with a frequency band that is adjacent to the frequency band and is denoted by a number "47" in FIG. 24 and a frequency band that is adjacent to the frequency band and is denoted by a number "48" in FIG. 24. In this way, the frequency band integrating unit 106*a* generates an integrated frequency band denoted by a number "1" in FIG. 24.

In addition, for example, the frequency band integrating unit 106*a* selects a frequency band denoted by a number "51" in FIG. 24 and integrates the selected frequency band with a frequency band that is adjacent to the frequency band and is denoted by a number "50" in FIG. 24 and a frequency band that is adjacent to the frequency band and is denoted by a number "52" in FIG. 24. In this way, the frequency band integrating unit 106*a* generates an integrated frequency band denoted by a number "2" in FIG. 24.

All the integrated frequency bands illustrated in FIGS. 23 and 24 have a frequency width of $\pm(1/12+1/24)=\pm 1/8\approx\pm 0.125$ octave. This frequency width is a frequency width that is in the same level as a frequency width for which a listener can identify a vertical angle of a direction in which a sound image is located within the median plane.

Each center frequency illustrated in FIGS. 23 and 24 represents a center frequency of each frequency band. The number of pinnas illustrated in FIG. 23 represents the number of pinnas in which a first notch is estimated to be included in each frequency band. The number of pinnas illustrated in FIG. 24 represents the number of pinnas in which a second notch is estimated to be included in each frequency band.

The integrated frequency band identifying unit 107*a* identifies a first integrated frequency band that includes a first notch and a second integrated frequency band that includes a second notch.

The relation deriving unit 108*a* executes a first process of deriving a relation between a first scale having a correlation with a first probability corresponding to the first integrated frequency band and the shape of the pinna of the listener for training for each of a plurality of integrated frequency bands.

For example, in the first process, the relation deriving unit 108*a* executes a discriminant analysis having the shape of the pinna of the listener for training as an explanatory variable and having a plurality of integrated frequency bands as objective variables in the first process, thereby calculating a first correlation matrix as a relation derived by the first process. In addition, in this case, the first scale is a Mahalanobis distance or a value calculated using the Mahalanobis distance.

In addition, the relation deriving unit 108*a* calculates a first scale using the first correlation matrix and the shape of the pinna of the listener for training and identifies an integrated frequency band having the highest first probability among the plurality of integrated frequency bands as a first integrated frequency band on the basis of the first scale.

Furthermore, relation deriving unit 108*a* executes a second process of deriving a relation between a second scale, which has a correlation with a second probability corresponding to a second integrated frequency band, and the shape of the pinna of the listener for training for each of a plurality of integrated frequency bands.

For example, in the second process, the relation deriving unit 108*a* executes a discriminant analysis having the shape of the pinna of the listener for training as an explanatory variable and having a plurality of integrated frequency bands as objective variables, thereby calculating a second correlation matrix as a relation derived by the second process. In addition, in this case, the second scale is a Mahalanobis distance or a value calculated using the Mahalanobis distance.

In addition, the relation deriving unit 108*a* calculates a second scale using the second correlation matrix and the shape of the pinna of the listener for training and identifies an integrated frequency band having the highest second probability among the plurality of integrated frequency bands as a second integrated frequency band on the basis of the second scale.

Next, a process in which the head-related transfer function generator 1*a* estimates an integrated frequency band including a first notch of the individualized head-related transfer function of a listener for inference and an integrated frequency band including a second notch of the individualized head-related transfer function of a listener for inference using the shape of the pinna of the listener for inference, the relation derived by the first process and the relation derived by the second process will be described.

The pinna shape acquiring unit 105 acquires data representing the shape of the pinna of a listener for inference. For example, this data is data that is similar to the data described with reference to FIG. 20.

The integrated frequency band estimating unit 109*a* executes a third process. More specifically, the integrated frequency band estimating unit 109*a* calculates a third scale having a correlation with a third probability corresponding to a third integrated frequency band including a first notch having the lowest frequency among notches included in the individualized head-related transfer function of a listener for inference using the shape of the pinna of the listener for inference and the first correlation matrix for each of a plurality of integrated frequency bands. Then, the integrated frequency band estimating unit 109*a* estimates an integrated frequency band having the highest third probability as a third integrated frequency band.

The integrated frequency band estimating unit 109*a* executes a fourth process. More specifically, the integrated frequency band estimating unit 109*a* calculates a fourth scale having a correlation with a fourth probability corresponding to a fourth integrated frequency band including a second notch having a second lowest frequency among the notches included in the individualized head-related transfer function of the listener for inference using the shape of the pinna of the listener for inference and the second correlation matrix for each of a plurality of integrated frequency bands. Then, the integrated frequency band estimating unit 109*a* estimates an integrated frequency band having the highest fourth probability as a fourth integrated frequency band.

The individualized head-related transfer function generating unit 110*a* generates an individualized head-related transfer function of a listener for inference using results of estimation of the third integrated frequency band and the fourth integrated frequency band acquired by the integrated frequency band estimating unit 109*a*. More specifically, the individualized head-related transfer function generating unit 110*a* applies a technique for generating an individualized head-related transfer function of a listener for inference to the integrated frequency bands using results of estimation of the third frequency band and the fourth frequency band acquired by the individualized head-related transfer function generating unit 109 described above. In accordance with this, the individualized head-related transfer function generating unit 110*a* generates an individualized head-related transfer function on the basis of the integrated frequency bands.

The individualized head-related impulse response generating unit 111*a* performs an inverse Fourier transform on the individualized head-related transfer function generated by the individualized head-related transfer function generating unit 110*a*, thereby generating an individualized head-related impulse response.

Next, an example of a process executed by the head-related transfer function generator according to the embodiment will be described with reference to FIGS. 25 to 31.

Figure 25:
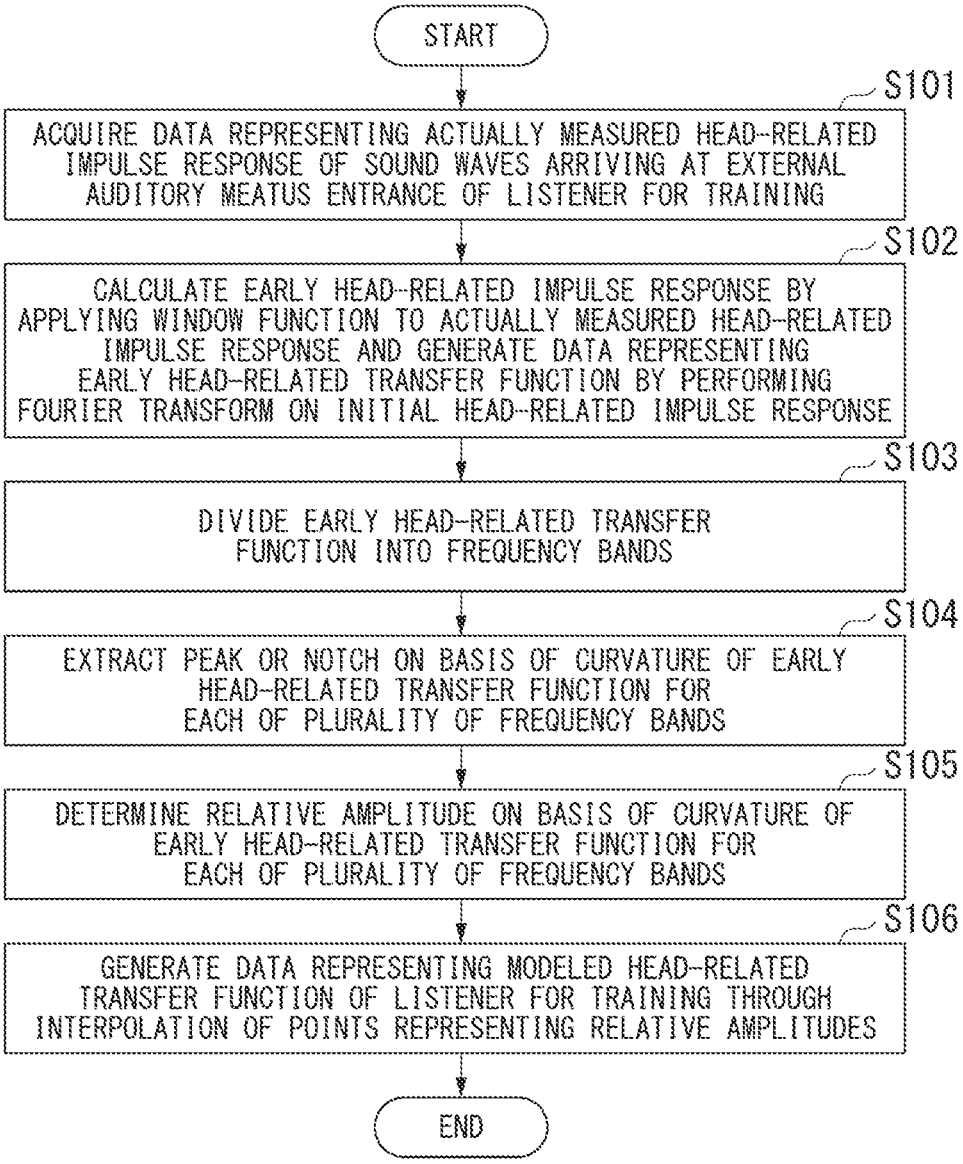
FIG. 25 is a flowchart illustrating an example of a process executed in a case in which a head-related transfer function generator according to the embodiment generates a modeled head-related transfer function.

FIG. 25 is a flowchart illustrating an example of a process performed in a case in which the head-related transfer function generator according to the embodiment generates a modeled head-related transfer function.

In Step S101, the actually measured head-related impulse response acquiring unit 101 acquires data that represents an actually measured head-related impulse response of sound waves arriving at the external auditory meatus entrance of a listener for training.

In Step S102, the early head-related transfer function generating unit 102 calculates an initial head-related impulse response by applying a window function to the actually measured head-related impulse response and performs a Fourier transform on the initial head-related impulse response, thereby generating data representing an early head-related transfer function.

In Step S103, the frequency band dividing unit 103 divides the early head-related transfer function into a plurality of frequency bands.

In Step S104, the modeled head-related transfer function generating unit 104 extracts peaks or notches on the basis of the curvature of the early head-related transfer function for each of the plurality of frequency bands.

In Step S105, the modeled head-related transfer function generating unit 104 determines a relative amplitude on the basis of the curvature of the early head-related transfer function for each of the plurality of frequency bands.

In Step S106 the modeled head-related transfer function generating unit 104 interpolates points representing relative amplitudes, thereby generating data representing a modeled head-related transfer function of a listener for training.

Figure 26:
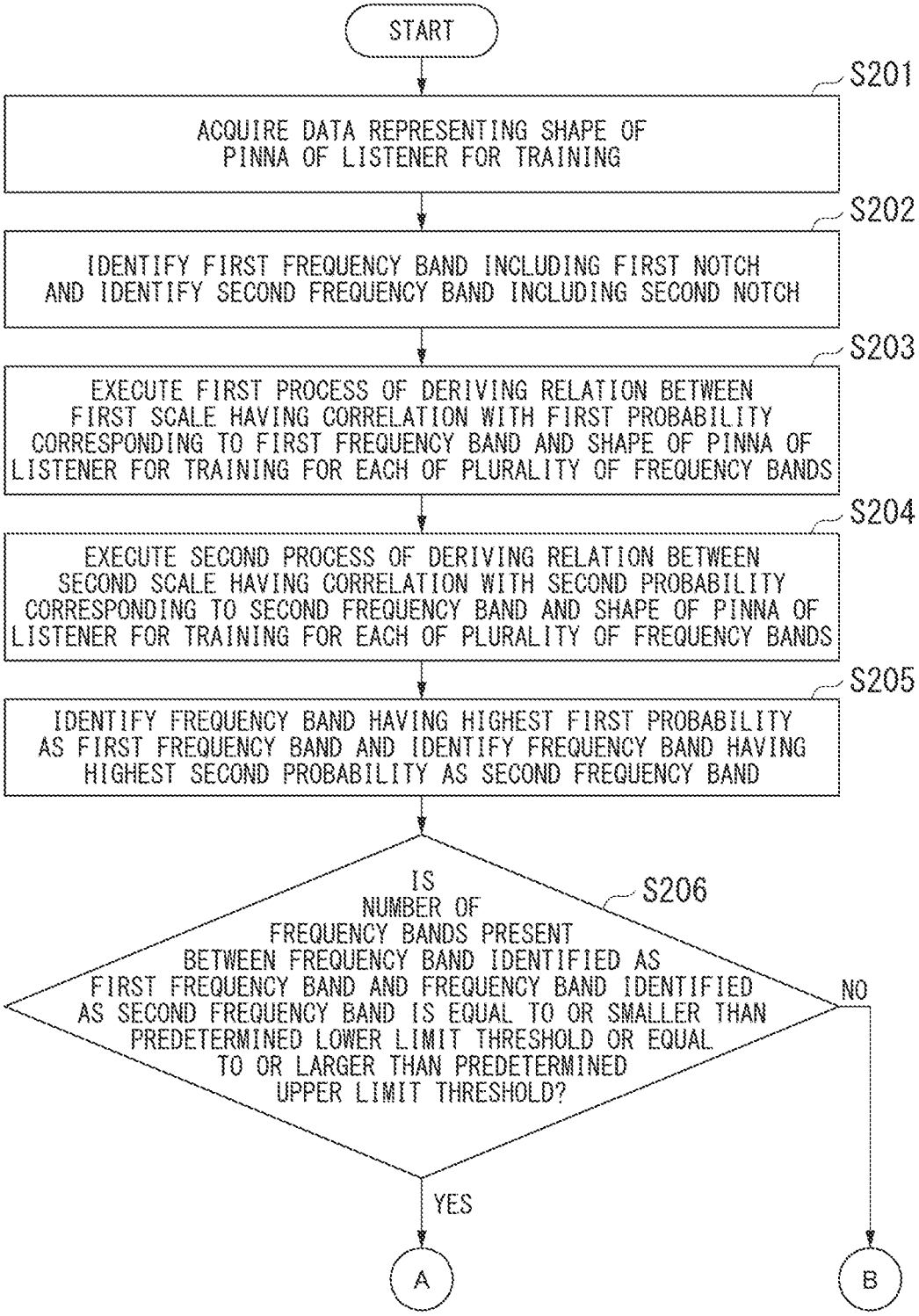
FIG. 26 is a flowchart illustrating an example of a process in which a head-related transfer function generator according to the embodiment identifies a first frequency band and a second frequency band.
Figure 27:
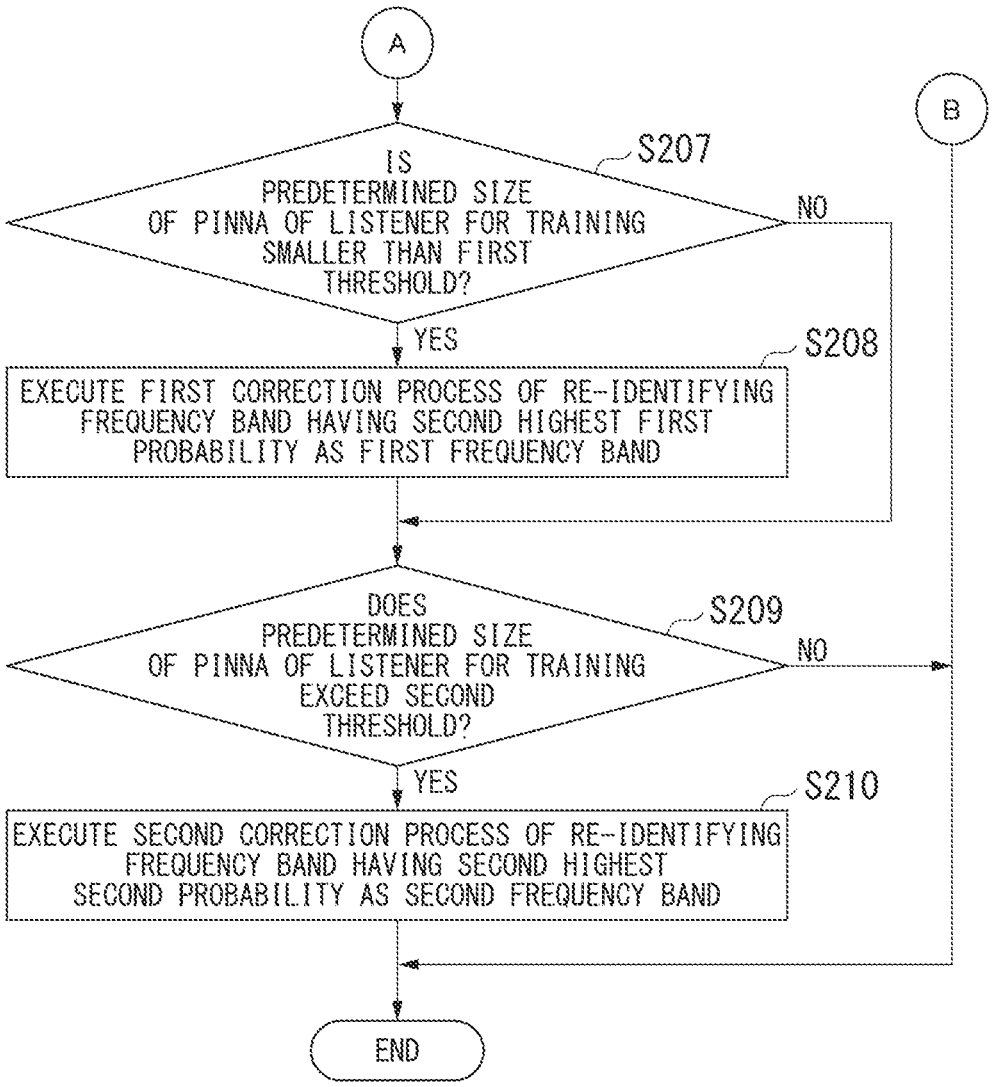
FIG. 27 is a flowchart illustrating an example of a process in which a head-related transfer function generator according to the embodiment identifies a first frequency band and a second frequency band.

FIGS. 26 and 27 are flowcharts illustrating an example of a process in which the head-related transfer function generator according to the embodiment identifies a first frequency band and a second frequency band.

In Step S201, the pinna shape acquiring unit 105 acquires data representing the shape of the pinna of a listener for training.

In Step S202, the frequency band identifying unit 106 identifies a first frequency band that includes a first notch and identifies a second frequency band that includes a second notch.

In Step S203, the relation deriving unit 107 executes the first process of deriving a relation between the first scale having a correlation with the first probability corresponding to the first frequency band and the shape of the pinna of the listener for training for each of a plurality of frequency bands.

In Step S204, the relation deriving unit 107 executes the second process of deriving a relation between the second scale having a correlation with the second probability corresponding to the second frequency band and the shape of the pinna of the listener for training for each of a plurality of frequency bands.

In Step S205, the relation deriving unit 107 identifies a frequency band having the highest first probability as the first frequency band and identifies a frequency band having the highest second probability as the second frequency band.

In Step S206, the relation deriving unit 107 determines whether or not the number of frequency bands present between the frequency band identified as the first frequency band and the frequency band identified as the second frequency band is equal to or smaller than a predetermined lower limit threshold or equal to or larger than a predetermined upper limit threshold. In a case in which it is determined that the number of frequency bands present between the frequency band identified as the first frequency band and the frequency band identified as the second frequency band is equal to or smaller than a predetermined lower limit threshold or equal to or larger than a predetermined upper limit threshold (Step S206: Yes), the relation deriving unit 107 causes the process to proceed to Step S207. On the other hand, in a case in which it is determined that the number of frequency bands present between the frequency band identified as the first frequency band and the frequency band identified as the second frequency band is neither equal to or smaller than the predetermined lower limit threshold nor equal to or larger than the predetermined upper limit threshold (Step S206: No), the relation deriving unit 107 ends the process.

In Step S207, the relation deriving unit 107 determines whether or not a predetermined size of the pinna of the listener for training is smaller than a first threshold. In a case in which it is determined that the predetermined size of the pinna of the listener for training is smaller than the first threshold (Step S207: Yes), the relation deriving unit 107 causes the process to proceed to Step S208. On the other hand, in a case in which it is determined that the predetermined size of the pinna of the listener for training is equal to or larger than the first threshold (Step S207: No), the relation deriving unit 107 causes the process to proceed to Step S209.

In Step S208, the relation deriving unit 107 executes the first correction process of re-identifying a frequency band having a second highest first probability as the first frequency band.

In Step S209, the relation deriving unit 107 determines whether or not the predetermined size of the pinna of the listener for training exceeds a second threshold. In a case in which it is determined that the predetermined size of the pinna of the listener for training exceeds the second threshold (Step S209: Yes), the relation deriving unit 107 causes the process to proceed to Step S210. On the other hand, in a case in which it is determined that the predetermined size of the pinna of the listener for training is equal to or smaller than the second threshold (Step S209: No), the relation deriving unit 107 causes the process to end.

In Step S210, the relation deriving unit 107 executes the second correction process of re-identifying a frequency band having a second highest second probability as the second frequency band.

Figure 28:
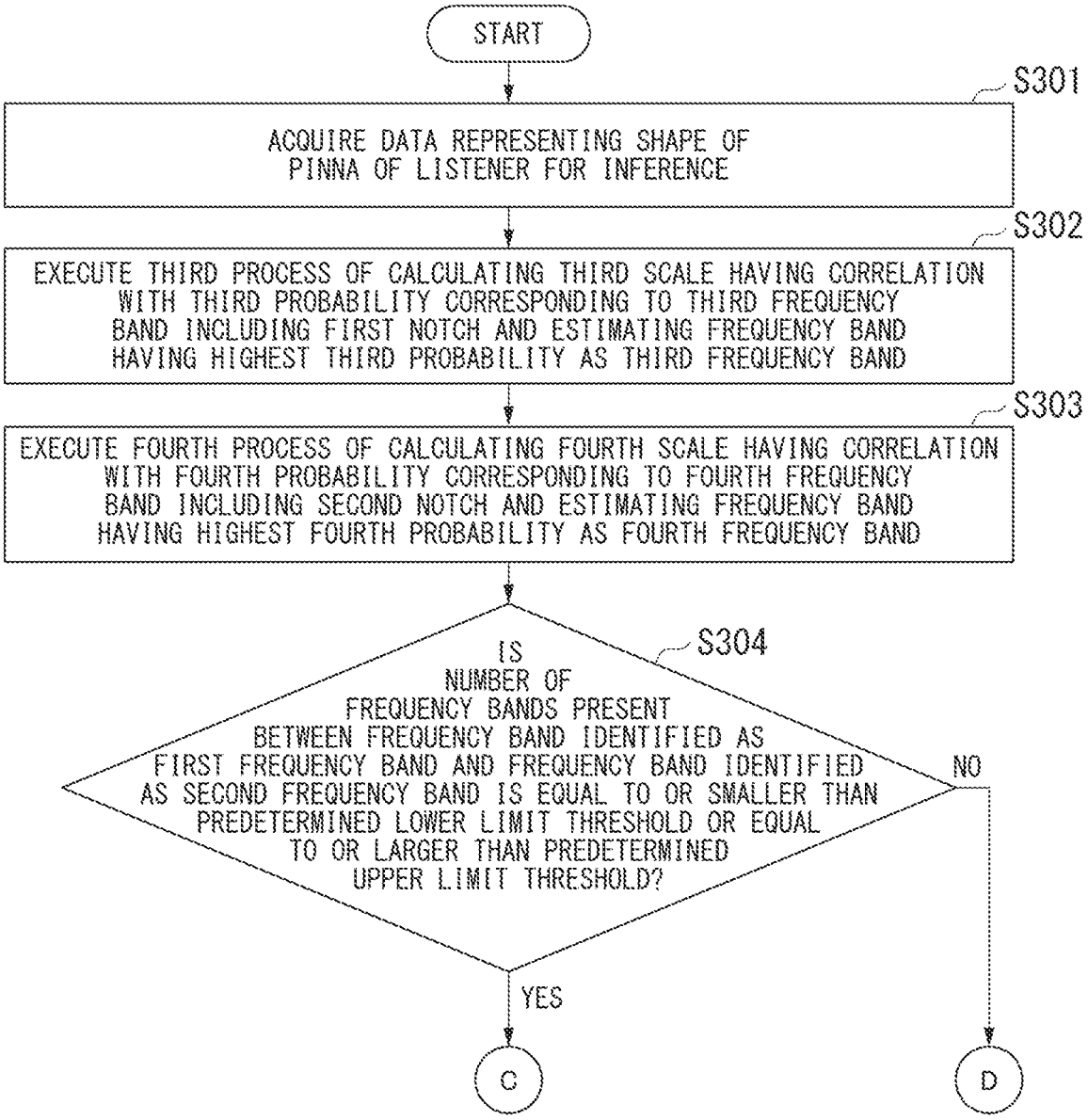
FIG. 28 is a flowchart illustrating an example of a process in which a head-related transfer function generator according to the embodiment identifies a third frequency band and a fourth frequency band.
Figure 29:
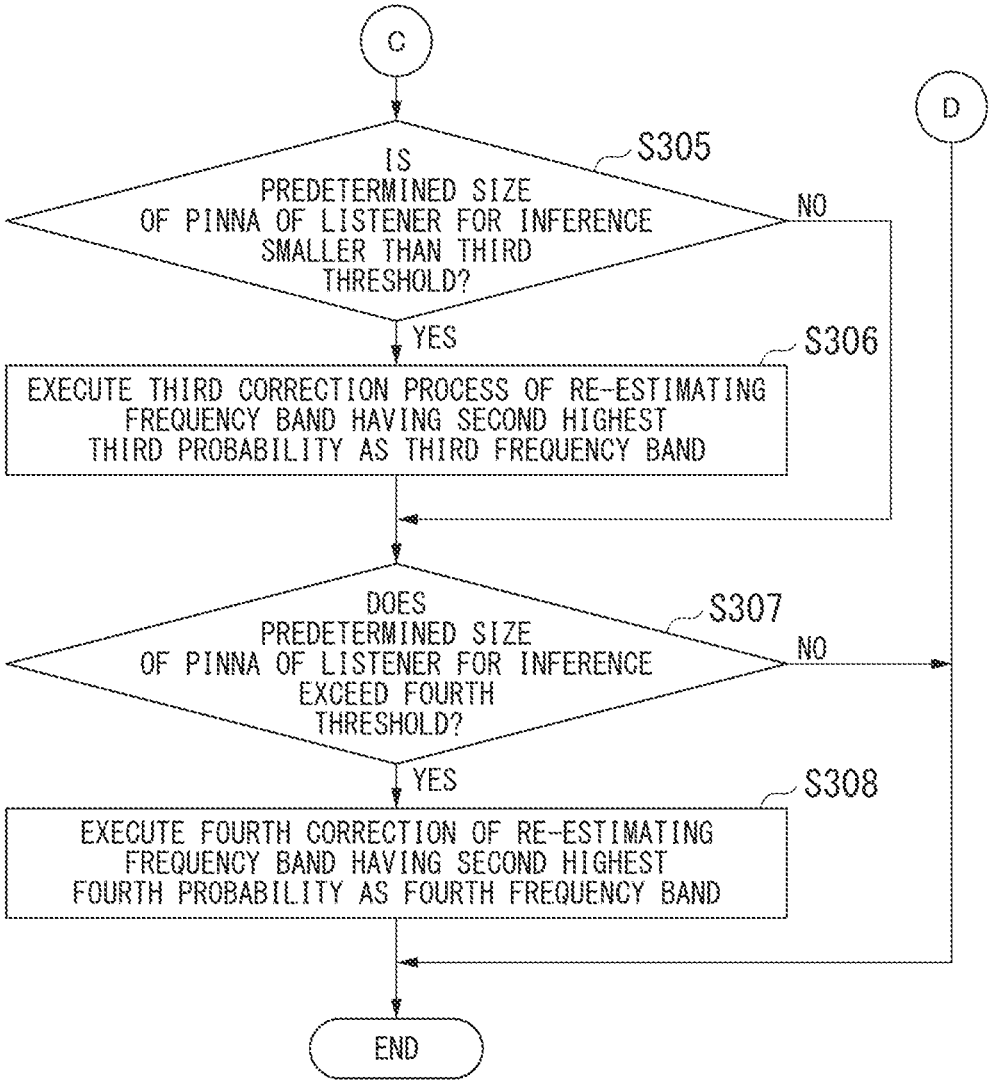
FIG. 29 is a flowchart illustrating an example of a process in which a head-related transfer function generator according to the embodiment identifies a third frequency band and a fourth frequency band.

FIGS. 28 and 29 are flowcharts illustrating an example of the process in which the head-related transfer function generator according to the embodiment identifies a third frequency band and a fourth frequency band.

In Step S301, the pinna shape acquiring unit 105 acquires data representing the shape of the pinna of a listener for inference.

In Step S302, the frequency band estimating unit 108 executes the third process of calculating a third scale having a correlation with the third probability corresponding to the third frequency band including a first notch and estimating a frequency band having the highest third probability as the third frequency band.

In Step S303, the frequency band estimating unit 108 executes the fourth process of calculating a fourth scale having a correlation with the fourth probability corresponding to the fourth frequency band including a second notch and estimating a frequency band having the highest fourth probability as the fourth frequency band.

In Step S304, the frequency band estimating unit 108 determines whether or not the number of frequency bands present between the frequency band identified as the first frequency band and the frequency band identified as the second frequency band is equal to or smaller than a predetermined lower limit threshold or equal to or larger than a predetermined upper limit threshold. In a case in which it is determined that the number of frequency bands present between the frequency band identified as the first frequency band and the frequency band identified as the second frequency band is equal to or smaller than the predetermined lower limit threshold or equal to or larger than the predetermined upper limit threshold (Step S304: Yes), the frequency band estimating unit 108 causes the process to proceed to Step S305. On the other hand, in a case in which it is determined that the number of frequency bands present between the frequency band identified as the first frequency band and the frequency band identified as the second frequency band is neither equal to or smaller than the predetermined lower limit threshold nor equal to or larger than the predetermined upper limit threshold (Step S304: No), the frequency band estimating unit 108 ends the process.

In Step S305, the frequency band estimating unit 108 determines whether or not a predetermined size of the pinna of the listener for inference is smaller than a third threshold. In a case in which it is determined that the predetermined size of the pinna of the listener for inference is smaller than the third threshold (Step S305: Yes), the frequency band estimating unit 108 causes the process to proceed to Step S306. On the other hand, in a case in which it is determined that the predetermined size of the pinna of the listener for inference is equal to or larger than the third threshold (Step S305: No), the frequency band estimating unit 108 ends the process.

In Step S306, the frequency band estimating unit 108 executes the third correction process of re-estimating a frequency band having a second highest third probability as the third frequency band.

In Step S307, the frequency band estimating unit 108 determines whether or not a predetermined size of the pinna of the listener for inference exceeds a fourth threshold. In a case in which it is determined that the predetermined size of the pinna of the listener for inference exceeds the fourth threshold (Step S307: Yes), the frequency band estimating unit 108 causes the process to proceed to Step S308. On the other hand, in a case in which it is determined that the predetermined size of the pinna of the listener for inference is equal to or smaller than the fourth threshold (Step S307: No), the frequency band estimating unit 108 ends the process.

In Step S308, the frequency band estimating unit 108 executes the fourth correction process of re-estimating a frequency band having a second highest fourth probability as the fourth frequency band.

Figure 30:
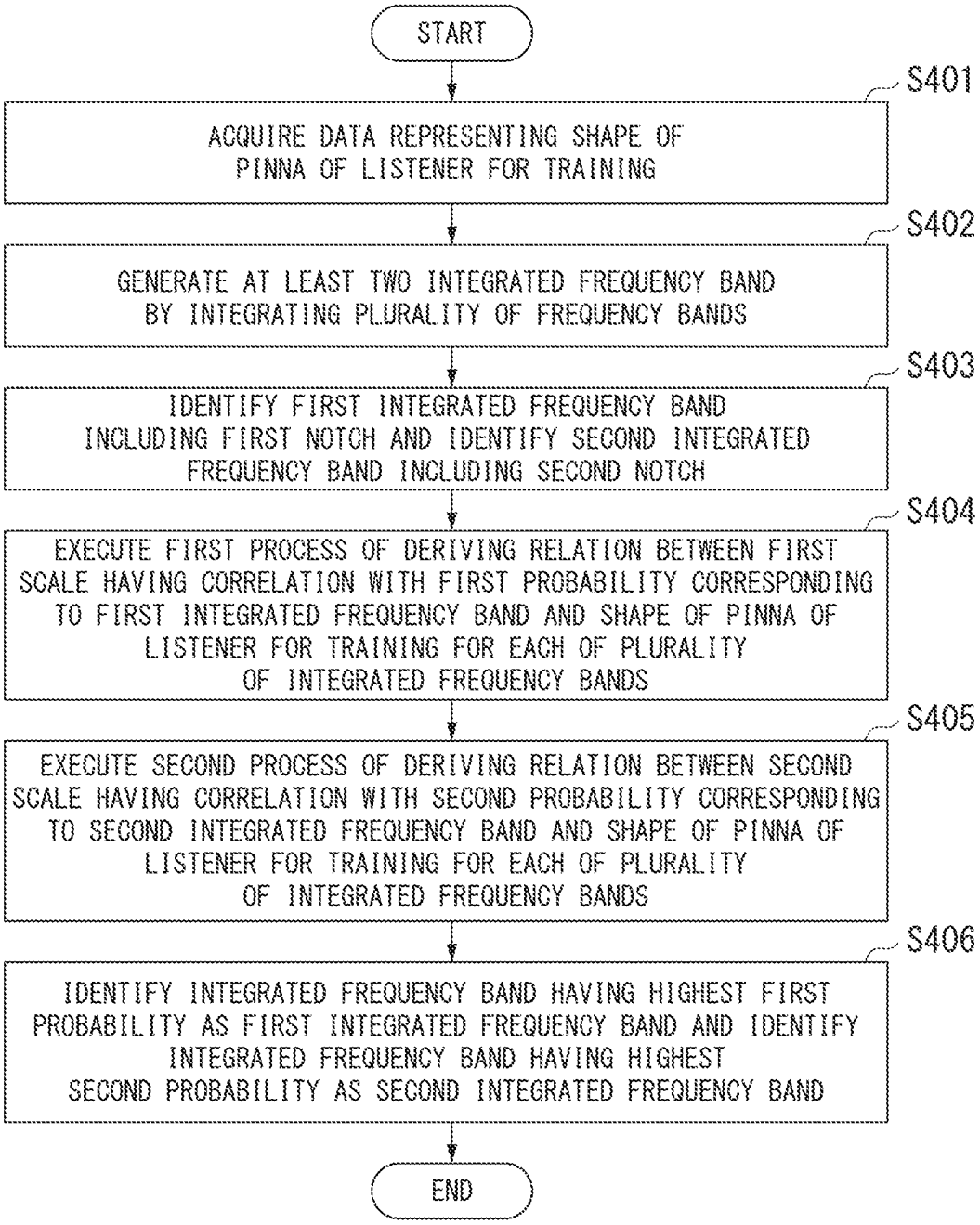
FIG. 30 is a flowchart illustrating an example of a process in which a head-related transfer function generator according to the embodiment identifies a first integrated frequency band and a second integrated frequency band.

FIG. 30 is a flowchart illustrating an example of the process of the head-related transfer function generator according to the embodiment identifying a first integrated frequency band and a second integrated frequency band.

In Step S401, the pinna shape acquiring unit 105 acquires data representing the shape of the pinna of a listener for training.

In Step S402, the frequency band integrating unit 106*a* generates at least two integrated frequency bands acquired by integrating a plurality of frequency bands.

In Step S403, the integrated frequency band identifying unit 107*a* identifies a first integrated frequency band that includes a first notch and identifies a second integrated frequency band that includes a second notch.

In Step S404, the relation deriving unit 108*a* the first process of deriving a relation between the first scale having a correlation with the first probability corresponding to the first integrated frequency band and the shape of the pinna of the listener for training for each of a plurality of integrated frequency bands.

In Step S405, the relation deriving unit 108*a* executes the second process of deriving a relation between the second scale having a correlation with the second probability corresponding to the second integrated frequency band and the shape of the pinna of the listener for training for each of a plurality of integrated frequency bands.

In Step S406, the relation deriving unit 108*a* identifies an integrated frequency band having the highest first probability as the first integrated frequency band and identifies an integrated frequency band having the highest second probability as the second integrated frequency band.

Figure 31:
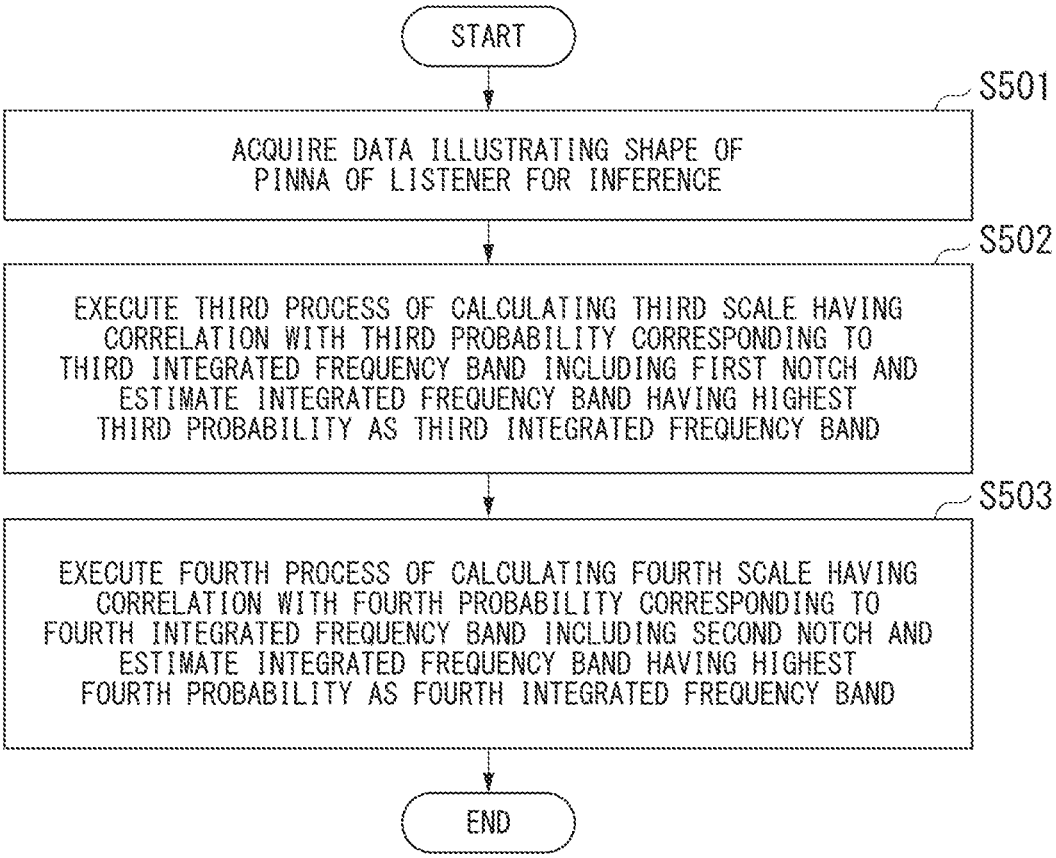
FIG. 31 is a flowchart illustrating an example of a process in which a head-related transfer function generator according to the embodiment estimates a third frequency band and a fourth frequency band.

FIG. 31 is a flowchart illustrating an example of the process of the head-related transfer function generator according to the embodiment estimating a third frequency band and a fourth frequency band.

In Step S501, the pinna shape acquiring unit 105 acquires data representing the shape of the pinna of a listener for inference.

In Step S502, the integrated frequency band estimating unit 109*a* executes the third process of calculating a third scale having a correlation with the third probability corresponding to the third integrated frequency band including a first notch and estimating an integrated frequency band having the highest third probability as the third integrated frequency band.

In Step S503, the integrated frequency band estimating unit 109*a* executes the fourth process of calculating a fourth scale having a correlation with the fourth probability corresponding to the fourth integrated frequency band including a second notch and estimating an integrated frequency band having the highest fourth probability as the fourth integrated frequency band.

As above, the head-related transfer function generator 1 according to the embodiment has been described. The head-related transfer function generator 1 executes the process of dividing the early head-related transfer function into a plurality of frequency bands and extracting a peak or a notch on the basis of the curvature of the early head-related transfer function for each of the plurality of frequency bands. Next, the head-related transfer function generator 1 executes the process of determining a relative amplitude on the basis of the curvature of the early head-related transfer function for each of the plurality of frequency bands. Then, the head-related transfer function generator 1 interpolates points representing relative amplitudes, thereby generating data that represents a modeled head-related transfer function of the listener for training.

In this way, the head-related transfer function generator 1 can acquire a modeled head-related transfer function, which reproduces the features of the head-related transfer function of the listener for training, without actually measuring the head-related transfer function of the listener for training.

In addition, the head-related transfer function generator 1 acquires data that represents the shape of the pinna of the listener for training. Next, the head-related transfer function generator 1 identifies a first frequency band and s second frequency band of the modeled head-related transfer function. Then, the head-related transfer function generator 1 executes the first process of deriving a relation between a first scale, which has a correlation with a first probability corresponding to a first frequency band, and the shape of the pinna of the listener for training for each of the plurality of frequency bands. In addition, the head-related transfer function generator 1 executes the second process of deriving a relation between a second scale, which has a correlation with a second probability corresponding to a second frequency band, and the shape of the pinna of the listener for training for each of the plurality of frequency bands.

In this way, the head-related transfer function generator 1 can derive a relation between the shape of the pinna and the first frequency band and a relation between the shape of the pinna and the second frequency band that can be used for generating a modeled head-related transfer function of the listener for inference.

In addition, in the first process, the head-related transfer function generator 1 executes a discriminant analysis having the shape of the pinna of the listener for training as an explanatory variable and having a plurality of frequency bands as objective variables, thereby calculating a first correlation matrix as a relation derived by the first process. Furthermore, in the second process, the head-related transfer function generator 1 executes a discriminant analysis having the shape of the pinna of the listener for training as an explanatory variable and having a plurality of frequency bands as objective variables, thereby calculating a second correlation matrix as a relation derived by the second process.

In this way, the head-related transfer function generator 1 can derive a relation between the shape of the pinna and the first frequency band and a relation between the shape of the pinna and the second frequency band with accuracy of a certain level or higher.

In addition, the head-related transfer function generator 1 calculates a first scale using the first correlation matrix and the shape of the pinna of the listener for training and identifies a frequency band having the highest first probability among the plurality of frequency bands as a first frequency band on the basis of the first scale. In addition, the head-related transfer function generator 1 calculates a second scale using the second correlation matrix and the shape of the pinna of the listener for training and identifies a frequency band having the highest second probability among the plurality of frequency bands as a second frequency band on the basis of the second scale.

In this way, the head-related transfer function generator 1 can identify the first frequency band and the second frequency band with accuracy of a certain level or higher.

In addition, the head-related transfer function generator 1 executes at least one of the first correction process and the second correction process described above in a case in which the number of frequency bands present between a frequency band identified as the first frequency band and a frequency band identified as the second frequency band is equal to or smaller than the predetermined lower limit threshold or equal to or larger than the predetermined upper limit threshold.

In this way, the head-related transfer function generator 1 can identify a first notch and a second notch with higher accuracy that achieve important roles in a case in which a listener perceives a vertical angle of the direction in which a sound image is located within the median plane.

In addition, the head-related transfer function generator 1 may execute the first correction process in a case in which the number of frequency bands present between a frequency band identified as the first frequency band and a frequency band identified as the second frequency band is equal to or smaller than a predetermined lower limit threshold or equal to or larger than a predetermined upper limit threshold, and a predetermined size of the pinna of the listener for training is smaller than a first threshold.

In this way, the head-related transfer function generator 1 executes the first correction process in a case in which the pinna of the listener for training is small, and the possibility of a frequency band identified first as the first frequency band being incorrect is relatively high and thus can identify the first frequency band with further higher accuracy.

In addition, the head-related transfer function generator 1 may execute the second correction process in a case in which the number of frequency bands present between a frequency band identified as the first frequency band and a frequency band identified as the second frequency band is equal to or smaller than the predetermined lower limit threshold or equal to or larger than the predetermined upper limit threshold, and a predetermined size of the pinna of the listener for training exceeds the second threshold.

In this way, the head-related transfer function generator 1 executes the second correction process in a case in which the pinna of the listener for training is large, and the possibility of a frequency band identified first as the second frequency band being incorrect is relatively high and can identify the second frequency band with further higher accuracy.

In addition, the head-related transfer function generator 1 acquires data that represents the shape of the pinna of a listener for inference. Then, the head-related transfer function generator 1 executes the third process and the fourth process. The third process is a process of calculating a third scale having a correlation with a third probability corresponding to a third frequency band including a first notch having the lowest frequency among notches included in the individualized head-related transfer function of a listener for inference using the shape of the pinna of the listener for inference and the first correlation matrix and estimating a frequency band having the highest third probability as a third frequency band. The fourth process is a process of calculating a fourth scale having a correlation with a fourth probability corresponding to a fourth frequency band including a second notch having the second lowest frequency among notches included in the individualized head-related transfer function of a listener for inference using the shape of the pinna of the listener for inference and the second correlation matrix and estimating a frequency band having the highest fourth probability as a fourth frequency band for each of a plurality of frequency bands.

In this way, the head-related transfer function generator 1 can estimate the third frequency band in which the first notch is included and the fourth frequency band in which the second notch is included with accuracy of a certain level or higher for the individualized head-related transfer function of a listener for inference whose shape of the pinna is unknown.

In addition, the head-related transfer function generator 1 executes at least one of the third correction process and the fourth correction process described above in a case in which the number of frequency bands present between a frequency band identified as the third frequency band and a frequency band identified as the fourth frequency band is equal to or smaller than a predetermined lower limit threshold or equal to or larger than a predetermined upper limit threshold.

In this way, the head-related transfer function generator 1 can estimate at least one of the third frequency band and the fourth frequency band with further higher accuracy for the individualized head-related transfer function of a listener for inference whose shape of the pinna is unknown.

In addition, the head-related transfer function generator 1 may execute the third correction process in a case in which the number of frequency bands present between a frequency band identified as the third frequency band and a frequency band identified as the fourth frequency band is equal to or smaller than the predetermined lower limit threshold or equal to or larger than the predetermined upper limit threshold, and a predetermined size of the pinna of the listener for inference is smaller than the third threshold.

In this way, the head-related transfer function generator 1 executes the third correction process in a case in which the pinna of the listener for inference is small, and the possibility of a frequency band identified first as the third frequency band being incorrect is relatively high and thus can identify the third frequency band with further higher accuracy.

In addition, the head-related transfer function generator 1 may execute the fourth correction process in a case in which the number of frequency bands present between a frequency band identified as the third frequency band and a frequency band identified as the fourth frequency band is equal to or smaller than the predetermined lower limit threshold or equal to or larger than the predetermined upper limit threshold, and a predetermined size of the pinna of the listener for inference exceeds the fourth threshold.

In this way, the head-related transfer function generator 1 executes the fourth correction process in a case in which the pinna of the listener for inference is small, and the possibility of a frequency band identified first as the fourth frequency band being incorrect is relatively high and thus can identify the fourth frequency band with further higher accuracy.

In addition, the head-related transfer function generator 1 generates an individualized head-related transfer function of the listener for inference using results of estimation of the third frequency band and the fourth frequency band that are acquired by the frequency band estimating unit 108.

In this way, the head-related transfer function generator 1 can acquire an individualized head-related transfer function that reproduces the first notch and the second notch, which achieve important roles in a case in which a listener for inference perceives a vertical angle of the direction in which a sound image is located within the median plane, with high accuracy.

In addition, the head-related transfer function generator 1*a* acquires data that represents the shape of the pinna of the listener for training. Next, the head-related transfer function generator 1*a* generates at least two integrated frequency bands acquired by integrating a plurality of frequency bands. Next, the head-related transfer function generator 1*a* identifies the first integrated frequency band and the second integrated frequency band of the modeled head-related transfer function. Then, the head-related transfer function generator 1*a* executes the first process of deriving a relation between a first scale, which has a correlation with a first probability corresponding to a first integrated frequency band, and the shape of the pinna of the listener for training for each of a plurality of integrated frequency bands. In addition, the head-related transfer function generator 1*a* executes the second process of deriving a relation between a second scale having a correlation with a second probability corresponding to a second integrated frequency band and the shape of the pinna of the listener for training for each of a plurality of integrated frequency bands.

In this way, the head-related transfer function generator 1*a* can derive a relation between the shape of the pinna and the first frequency band that can be used for generating a modeled head-related transfer function of a listener for training on the basis of a frequency width that can be identified by the listener for training. In addition, in this way, the head-related transfer function generator 1*a* can derive a relation between the shape of the pinna and the second frequency band that can be used for generating a modeled head-related transfer function of a listener for training on the basis of a frequency width that can be identified by the listener for training.

In addition, the head-related transfer function generator 1*a* executes a discriminant analysis having the shape of the pinna of the listener for training as an explanatory variable and having a plurality of integrated frequency bands as objective variables in the first process, thereby calculating a first correlation matrix as a relation derived by the first process. Furthermore, the head-related transfer function generator 1*a* executes a discriminant analysis having the shape of the pinna of the listener for training as an explanatory variable and having a plurality of integrated frequency bands as objective variables in the second process, thereby calculating a second correlation matrix as a relation derived by the second process.

In this way, the head-related transfer function generator 1*a* can derive a relation between the shape of the pinna and the first frequency band that has accuracy of a certain level or higher and matches a frequency width that can be identified by the listener for training. In addition, in this way, the head-related transfer function generator 1*a* can derive a relation between the shape of the pinna and the second frequency band that has accuracy of a certain level or higher and matches a frequency width that can be identified by the listener for training.

In addition, the head-related transfer function generator 1*a* calculates a first scale using the first correlation matrix and the shape of the pinna of the listener for training and identifies an integrated frequency band having the highest first probability among the plurality of integrated frequency bands as a first integrated frequency band on the basis of the first scale. Furthermore, the head-related transfer function generator 1*a* calculates a second scale using the second correlation matrix and the shape of the pinna of the listener for training and identifies an integrated frequency band having the highest second probability among the plurality of integrated frequency bands as a second integrated frequency band on the basis of the second scale.

In this way, the head-related transfer function generator 1*a* can identify a first integrated frequency band that has accuracy of a certain level or higher and is based on the frequency width that can be identified by the listener for training. In addition, in this way, the head-related transfer function generator 1*a* can identify a second integrated frequency band that has accuracy of a certain level or higher and is based on the frequency width that can be identified by the listener for training.

In addition, the head-related transfer function generator 1*a* acquires data that represents the shape of the pinna of the listener for inference. Then, the head-related transfer function generator 1*a* executes the third process and the fourth process. The third process is a process of calculating a third scale having a correlation with a third probability corresponding to a third integrated frequency band including a first notch having the lowest frequency among notches included in the individualized head-related transfer function of a listener for inference using the shape of the pinna of the listener for inference and the first correlation matrix and estimating an integrated frequency band having the highest third probability as a third integrated frequency band for each of the plurality of integrated frequency bands. The fourth process is a process of calculating a fourth scale having a correlation with a fourth probability corresponding to a fourth integrated frequency band including a second notch having the second lowest frequency among notches included in the individualized head-related transfer function of a listener for inference using the shape of the pinna of the listener for inference and the second correlation matrix and estimating an integrated frequency band having the highest fourth probability as a fourth integrated frequency band for each of the plurality of integrated frequency bands.

In this way, the head-related transfer function generator 1*a* can estimate the third integrated frequency band that has accuracy of a certain level or higher and is based on a frequency width that can be identified by the listener for training for an individualized head-related transfer function of the listener for inference whose shape of the pinna is unknown. In addition, in this way, the head-related transfer function generator 1*a* can estimate the fourth integrated frequency band that has accuracy of a certain level or higher and is based on a frequency width that can be identified by the listener for training for an individualized head-related transfer function of the listener for inference whose shape of the pinna is unknown.

In addition, in the embodiment described above, although a case in which the head-related transfer function generator 1 calculates the first correlation matrix and the second correlation matrix by executing a discriminant analysis has been described as an example, the configuration is not limited thereto.

For example, the relation deriving unit 107, in the first process, may derive a first learned model that has been caused to learn using training data having the shape of the pinna of a listener for training as a problem and having a first frequency band as an answer as a relation derived by the first process. In such a case, the relation deriving unit 107 calculates a first scale using the first learned model and the shape of the pinna of the listener for training and identifies a frequency band having the highest first probability among a plurality of frequency bands as a first frequency band on the basis of the first scale.

In addition, for example, the relation deriving unit 107, in the second process, may derive a second learned model that has been caused to learn using training data having the shape of the pinna of a listener for training as a problem and having a second frequency band as an answer as a relation derived by the second process. In such a case, the relation deriving unit 107 calculates a second scale using the second learned model and the shape of the pinna of the listener for training and identifies a frequency band having the highest second probability among a plurality of frequency bands as a second frequency band on the basis of the second scale.

In addition, for example, the relation deriving unit 108*a*, in the first process, may derive a first learned model that has been caused to learn using training data having the shape of the pinna of a listener for training as a problem and having a first integrated frequency band as an answer as a relation derived by the first process. In such a case, the relation deriving unit 108*a* calculates a first scale using the first learned model and the shape of the pinna of the listener for training and identifies an integrated frequency band having the highest first probability among a plurality of integrated frequency bands as a first integrated frequency band on the basis of the first scale.

In addition, for example, the relation deriving unit 108*a*, in the second process, may derive a second learned model that has been caused to learn using training data having the shape of the pinna of a listener for training as a problem and having a second integrated frequency band as an answer as a relation derived by the second process. In such a case, the relation deriving unit 108*a* calculates a second scale using the second learned model and the shape of the pinna of the listener for training and identifies an integrated frequency band having the highest second probability among a plurality of integrated frequency bands as a second integrated frequency band on the basis of the second scale.

In addition, in the embodiment described above, a case in which the head-related transfer function generator 1 calculates the third scale using the first correlation matrix and calculates the fourth scale using the second correlation matrix has been described as an example, the configuration is not limited thereto. For example, the frequency band estimating unit 108 may calculate the third scale using the first learned model. In addition, for example, the frequency band estimating unit 108 may calculate the fourth scale using the second learned model.

In addition, in the embodiment described above, a case in which the head-related transfer function generator 1*a* calculates the third scale using the first correlation matrix and calculates the fourth scale using the second correlation matrix has been described as an example, the configuration is not limited thereto. For example, the integrated frequency band estimating unit 109*a* may calculate the third scale using the first learned model. In addition, for example, the integrated frequency band estimating unit 109*a* may calculate the fourth scale using the second learned model.

Furthermore, at least some of the functions of the head-related transfer function generator 1 according to the embodiment described above may be realized by recording a program for realizing such functions in a computer-readable recording medium and causing a computer system to read and execute the program recorded in this recording medium. The "computer system" described here includes an operating system (OS) and hardware such as peripherals.

Furthermore, the "computer-readable recording medium" represents a portable medium such as a flexible disk, a magneto-optical disk, a ROM, or a CD-ROM or a storage unit such as a hard disk built into the computer system. In addition, the "computer-readable recording medium" may include a medium dynamically storing the program for a short time such as a communication line in a case in which the program is transmitted via a network such as the Internet or a communication line such as a telephone line and a medium storing the program for a predetermined time such as a volatile memory inside a computer system serving as a server or a client in the case. In addition, the program described above may be used for realizing some of the functions described above and may realize the functions described above in combination with a program that has already been recorded in the computer system.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1, 1*a* head-related transfer function generator
11 processor
12 main storage device
13 communication interface
14 auxiliary storage device
15 input/output device
101 actually measured head-related impulse response acquiring unit
102 early head-related transfer function generating unit
103 frequency band dividing unit
104 modeled head-related transfer function generating unit
105 pinna shape acquiring unit

106, 107*a* frequency band identifying unit
106*a* frequency band integrating unit
107, 108*a* relation deriving unit
108 frequency band estimating unit
109, 110*a* individualized head-related transfer function generating unit
109*a* integrated frequency band estimating unit
110, 111*a* individualized head-related impulse response generating unit
151 mouse
152 keyboard
153 display

What is claimed is:

1. A head-related transfer function generator comprising:

an actually measured head-related impulse response acquiring circuitry configured to acquire data that represents an actually measured head-related impulse response of sound waves arriving at external auditory meatus entrances of a listener for training;

an early head-related transfer function generating circuitry configured to calculate an initial head-related impulse response by applying a window function to the actually measured head-related impulse response and generate data representing an early head-related transfer function by performing a Fourier transform on the initial head-related impulse response;

a frequency band dividing circuitry configured to divide the early head-related transfer function into a plurality of frequency bands; and a modeled head-related transfer function generating circuitry configured to execute a process of extracting a peak or a notch on the basis of curvature of the early head-related transfer function and a process of determining a relative amplitude for each of the plurality of frequency bands and generate data representing a modeled head-related transfer function of the listener for training by interpolating points representing the relative amplitudes.

2. The head-related transfer function generator according to claim 1, further comprising:

a pinna shape acquiring circuitry configured to acquire data that represents a shape of a pinna of the listener for training;

a frequency band identifying circuitry configured to identify a first frequency band including a first notch having a lowest frequency among notches included in the modeled head-related transfer function of the listener for training and a second frequency band including a second notch having a second lowest frequency among the notches included in the modeled head-related transfer function of the listener for training; and a relation deriving circuitry configured to execute a first process of deriving a relation between a first scale having a correlation with a first probability corresponding to the first frequency band and the shape of the pinna of the listener for training for each of the plurality of frequency bands and execute a second process of deriving a relation between a second scale having a correlation with a second probability corresponding to the second frequency band and the shape of the pinna of the listener for training for each of the plurality of frequency bands.

3. The head-related transfer function generator according to claim 2, wherein the relation deriving circuitry is configured to calculate a first correlation matrix as the relation derived by the first process by executing a discriminant analysis having the shape of the pinna of the listener for training as an explanatory variable and having the plurality of frequency bands as objective variables in the first process and calculate a second correlation matrix as the relation derived by the second process by executing a discriminant analysis having the shape of the pinna of the listener for training as an explanatory variable and having the plurality of frequency bands as objective variables in the second process.

4. The head-related transfer function generator according to claim 3, wherein the relation deriving circuitry is configured to calculate the first scale using the first correlation matrix and the shape of the pinna of the listener for training, identify a frequency band having a highest first probability among the plurality of frequency bands as the first frequency band on the basis of the first scale, calculate the second scale using the second correlation matrix and the shape of the pinna of the listener for training, and identify a frequency band having a highest second probability among the plurality of frequency bands as the second frequency band on the basis of the second scale.

5. The head-related transfer function generator according to claim 4, wherein the relation deriving circuitry is configured to execute at least one of a first correction process of re-identifying a frequency band having a second highest first probability as the first frequency band and a second correction process of re-identifying a frequency band having a second highest second probability as the second frequency band in a case in which the number of frequency bands present between the frequency band identified as the first frequency band and the frequency band identified as the second frequency band is equal to or smaller than a predetermined lower limit threshold or equal to or larger than a predetermined upper limit threshold.

6. The head-related transfer function generator according to claim 5, wherein the relation deriving circuitry is configured to execute the first correction process in a case in which the number of frequency bands present between the frequency band identified as the first frequency band and the frequency band identified as the second frequency band is equal to or smaller than the predetermined lower limit threshold or equal to or larger than the predetermined upper limit threshold, and a predetermined size of the pinna of the listener for training is smaller than a first threshold.

7. The head-related transfer function generator according to claim 5, wherein the relation deriving circuitry is configured to execute the second correction process in a case in which the number of frequency bands present between the frequency band identified as the first frequency band and the frequency band identified as the second frequency band is equal to or smaller than the predetermined lower limit threshold or equal to or larger than the predetermined upper limit threshold, and a predetermined size of the pinna of the listener for training exceeds a second threshold.

8. The head-related transfer function generator according to claim 2, wherein the relation deriving circuitry is configured to derive a first learned model that has been caused to learn using training data having the shape of the pinna of the listener for training as a problem and having the first frequency band as an answer as the relation derived by the first process in the first process and derive a second learned model that has been caused to learn using training data having the shape of the pinna of the listener for training as a problem and having the second frequency band as an answer as the relation derived by the second process in the second process.

9. The head-related transfer function generator according to claim 8, wherein the relation deriving circuitry is configured to calculate the first scale using the first learned model and the shape of the pinna of the listener for training, identify a frequency band having a highest first probability among the plurality of frequency bands as the first frequency band on the basis of the first scale, calculate the second scale using the second learned model and the shape of the pinna of the listener for training, and identify a frequency band having a highest second probability among the plurality of frequency bands as the second frequency band on the basis of the second scale.

10. The head-related transfer function generator according to claim 8, wherein the pinna shape acquiring circuitry is further configured to acquire data representing a shape of a pinna of a listener for inference, the head-related transfer function generator further comprising a frequency band estimating circuitry configured to execute a third process of calculating a third scale having a correlation with a third probability corresponding to a third frequency band including a first notch having a lowest frequency among notches included in an individualized head-related transfer function of the listener for inference using the shape of the pinna of the listener for inference and the first learned model and estimating a frequency band having a highest third probability as the third frequency band for each of the plurality of frequency bands and execute a fourth process of calculating a fourth scale having a correlation with a fourth probability corresponding to a fourth frequency band including a second notch having a second lowest frequency among the notches included in the individualized head-related transfer function of the listener for inference using the shape of the pinna of the listener for inference and the second learned model and estimating a frequency band having a highest fourth probability as the fourth frequency band for each of the plurality of frequency bands.

11. The head-related transfer function generator according to claim 3, wherein the pinna shape acquiring circuitry is further configured to acquire data that represents a shape of a pinna of a listener for inference, the head-related transfer function generator further comprising a frequency band estimating circuitry configured to execute a third process of calculating a third scale having a correlation with a third probability corresponding to a third frequency band including a first notch having a lowest frequency among notches included in an individualized head-related transfer function of the listener for inference using the shape of the pinna of the listener for inference and the first correlation matrix and estimating a frequency band having a highest third probability as the third frequency band for each of the plurality of frequency bands and execute a fourth process of calculating a fourth scale having a correlation with a fourth probability corresponding to a fourth frequency band including a second notch having a second lowest frequency among the notches included in the individualized head-related transfer function of the listener for inference using the shape of the pinna of the listener for inference and the second correlation matrix and estimating a frequency band having a highest fourth probability as the fourth frequency band for each of the plurality of frequency bands.

12. The head-related transfer function generator according to claim 11, wherein the frequency band estimating circuitry is further configured to execute at least one of a third correction process of re-estimating a frequency band having a second highest third probability as the third frequency band and a fourth correction process of re-estimating a frequency band having a second highest fourth probability as the fourth frequency band in a case in which the number of frequency bands present between the frequency band estimated as the third frequency band and the frequency band estimated as the fourth frequency band is equal to or smaller than a predetermined lower limit threshold or equal to or larger than a predetermined upper limit threshold.

13. The head-related transfer function generator according to claim 12, wherein the frequency band estimating circuitry is configured to execute the third correction process in a case in which the number of frequency bands present between the frequency band estimated as the third frequency band and the frequency band estimated as the fourth frequency band is equal to or smaller than a predetermined lower limit threshold or equal to or larger than a predetermined upper limit threshold, and a predetermined size of the pinna of the listener for inference is smaller than a third threshold.

14. The head-related transfer function generator according to claim 12, wherein the frequency band estimating circuitry is configured to execute the fourth correction process in a case in which the number of frequency bands present between the frequency band estimated as the third frequency band and the frequency band estimated as the fourth frequency band is equal to or smaller than a predetermined lower limit threshold or equal to or larger than a predetermined upper limit threshold, and a predetermined size of the pinna of the listener for inference exceeds a fourth threshold.

15. The head-related transfer function generator according to claim 11, wherein the frequency band estimating circuitry further includes an individualized head-related transfer function generating circuitry configured to generate an individualized head-related transfer function of the listener for inference using results of estimation of the third frequency band and the fourth frequency band acquired by the frequency band estimating circuitry.

16. The head-related transfer function generator according to claim 1, further comprising:

a pinna shape acquiring circuitry configured to acquire data that represents a shape of a pinna of the listener for training;

a frequency band integrating circuitry configured to generate at least two integrated frequency bands acquired by integrating a plurality of the frequency bands;

an integrated frequency band identifying circuitry configured to identify a first integrated frequency band including a first notch having a lowest frequency among notches included in the modeled head-related transfer function of the listener for training and a second integrated frequency band including a second notch having a second lowest frequency among notches included in the modeled head-related transfer function of the listener for training; and a relation deriving circuitry configured to execute a first process of deriving a relation between a first scale having a correlation with a first probability corresponding to the first integrated frequency band and the shape of the pinna of the listener for training for each of the plurality of integrated frequency bands and execute a second process of deriving a relation between a second scale having a correlation with a second probability corresponding to the second integrated frequency band and the shape of the pinna of the listener for training for each of the plurality of integrated frequency bands.

17. The head-related transfer function generator according to claim 16, wherein the relation deriving circuitry is configured to calculate a first correlation matrix as the relation derived by the first process by executing a discriminant analysis having the shape of the pinna of the listener for training as an explanatory variable and having the plurality of integrated frequency bands as objective variables in the first process and calculate a second correlation matrix as the relation derived by the second process by executing a discriminant analysis having the shape of the pinna of the listener for training as an explanatory variable and having the plurality of integrated frequency bands as objective variables in the second process.

18. The head-related transfer function generator according to claim 17, wherein the relation deriving circuitry is configured to calculate the first scale using the first correlation matrix and the shape of the pinna of the listener for training, identify an integrated frequency band having a highest first probability among the plurality of integrated frequency bands as the first integrated frequency band on the basis of the first scale, calculate the second scale using the second correlation matrix and the shape of the pinna of the listener for training, and identify an integrated frequency band having a highest second probability among the plurality of integrated frequency bands as the second integrated frequency band on the basis of the second scale.

19. The head-related transfer function generator according to claim 17, wherein the pinna shape acquiring circuitry is further configured to acquire data that represents a shape of a pinna of a listener for inference, the head-related transfer function generator further comprising an integrated frequency band estimating circuitry configured to execute a third process of calculating a third scale having a correlation with a third probability corresponding to a third integrated frequency band including a first notch having a lowest frequency among notches included in an individualized head-related transfer function of the listener for inference using the shape of the pinna of the listener for inference and the first correlation matrix and estimating an integrated frequency band having a highest third probability as the third integrated frequency band for each of the plurality of integrated frequency bands and execute a fourth process of calculating a fourth scale having a correlation with a fourth probability corresponding to a fourth integrated frequency band including a second notch having a second lowest frequency among the notches included in the individualized head-related transfer function of the listener for inference using the shape of the pinna of the listener for inference and the second correlation matrix and estimating an integrated frequency band having a highest fourth probability as the fourth integrated frequency band for each of the plurality of integrated frequency bands.

20. The head-related transfer function generator according to claim 16, wherein the relation deriving circuitry is configured to derive a first learned model that has been caused to learn using training data having the shape of the pinna of the listener for training as a problem and having the first integrated frequency band as an answer as the relation derived by the first process in the first process and derive a second learned model that has been caused to learn using training data having the shape of the pinna of the listener for training as a problem and having the second integrated frequency band as an answer as the relation derived by the second process in the second process.

21. The head-related transfer function generator according to claim 20, wherein the relation deriving circuitry is configured to calculate the first scale using the first learned model and the shape of the pinna of the listener for training, identifies an integrated frequency band having a highest first probability among the plurality of integrated frequency bands as the first integrated frequency band on the basis of the first scale, calculate the second scale using the second learned model and the shape of the pinna of the listener for training, and identifies an integrated frequency band having a highest second probability among the plurality of integrated frequency bands as the second integrated frequency band on the basis of the second scale.

22. The head-related transfer function generator according to claim 20, wherein the pinna shape acquiring circuitry is further configured to acquire data that represents a shape of a pinna of a listener for inference, the head-related transfer function generator further comprising an integrated frequency band estimating circuitry configured to execute a third process of calculating a third scale having a correlation with a third probability corresponding to a third integrated frequency band including a first notch having a lowest frequency among notches included in an individualized head-related transfer function of the listener for inference using the shape of the pinna of the listener for inference and the first learned model and estimating an integrated frequency band having a highest third probability as the third integrated frequency band for each of the plurality of integrated frequency bands and execute a fourth process of calculating a fourth scale having a correlation with a fourth probability corresponding to a fourth integrated frequency band including a second notch having a second lowest frequency among the notches included in the individualized head-related transfer function of the listener for inference using the shape of the pinna of the listener for inference and the second learned model and estimating an integrated frequency band having a highest fourth probability as the fourth integrated frequency band for each of the plurality of integrated frequency bands.

23. A non-transitory recording medium recording a head-related transfer function generation program causing a computer to execute:

acquiring data that represents an actually measured head-related impulse response of sound waves arriving at external auditory meatus entrances of a listener for training;

calculating an initial head-related impulse response by applying a window function to the actually measured head-related impulse response and generating data representing an early head-related transfer function by performing a Fourier transform on the initial head-related impulse response;

dividing the early head-related transfer function into a plurality of frequency bands; and executing a process of extracting a peak or a notch on the basis of curvature of the early head-related transfer function and a process of determining a relative amplitude for each of the plurality of frequency bands and generating data representing a modeled head-related transfer function of the listener for training by interpolating points representing the relative amplitudes.

24. A head-related transfer function generation method comprising:

acquiring data that represents an actually measured head-related impulse response of sound waves arriving at external auditory meatus entrances of a listener for training;

calculating an initial head-related impulse response by applying a window function to the actually measured head-related impulse response and generating data representing an early head-related transfer function by performing a Fourier transform on the initial head-related impulse response;

dividing the early head-related transfer function into a plurality of frequency bands; and executing a process of extracting a peak or a notch on the basis of curvature of the early head-related transfer function and a process of determining a relative amplitude for each of the plurality of frequency bands and generating data representing a modeled head-related transfer function of the listener for training by interpolating points representing the relative amplitudes.

* * * * *